US012473826B1

(12) United States Patent
Hird et al.

(10) Patent No.: US 12,473,826 B1
(45) Date of Patent: Nov. 18, 2025

(54) INSTRUMENTED MOVABLE DRILL BIT CUTTER

(71) Applicant: Schlumberger Technology Corporation, Sugar Land, TX (US)

(72) Inventors: Jonathan Robert Hird, Cambridge (GB); Jonathan Dunlop, Cambridge (GB); Ashley Bernard Johnson, Milton (GB); Andrew David Robinson, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/813,157

(22) Filed: Aug. 23, 2024

(51) Int. Cl.
*E21B 10/43* (2006.01)
*E21B 47/013* (2012.01)
*E21B 49/00* (2006.01)

(52) U.S. Cl.
CPC ..... *E21B 49/003* (2013.01); *E21B 10/43* (2013.01); *E21B 47/013* (2020.05)

(58) Field of Classification Search
CPC ..... E21B 49/003; E21B 10/43; E21B 47/013
See application file for complete search history.

(56) References Cited

U.S. PATENT DOCUMENTS 4,785,894 A * 11/1988 Davis, Jr. ..... E21B 10/22 175/39
6,142,250 A * 11/2000 Griffin ..... E21B 44/005 175/426
8,091,655 B2 * 1/2012 Shen ..... E21B 10/52 175/426
8,757,291 B2 * 6/2014 Kumar ..... E21B 47/013 175/50
9,885,234 B2 * 2/2018 Pelletier ..... E21B 47/013
9,945,181 B2 * 4/2018 Pelletier ..... E21B 49/005
9,957,792 B2 * 5/2018 Pelletier ..... E21B 47/113
10,006,279 B2 * 6/2018 Pelletier ..... G01P 15/097
10,012,067 B2 * 7/2018 Pelletier ..... E21B 45/00
10,012,070 B2 * 7/2018 Pelletier ..... E21B 47/092
10,167,718 B2 * 1/2019 Pelletier ..... E21B 44/00
10,174,563 B2 * 1/2019 Thomas ..... E21B 10/42
10,233,698 B2 * 3/2019 Humphrey ..... E21B 47/07
10,415,317 B2 * 9/2019 Bomidi ..... E21B 10/62
10,450,806 B2 * 10/2019 Bomidi ..... E21B 10/633
10,487,590 B2 * 11/2019 Schroder ..... E21B 10/62
10,794,171 B2 * 10/2020 Rivera-Rios ..... E21B 47/013
11,111,730 B2 * 9/2021 Chanpura ..... E21B 10/62
11,506,043 B2 * 11/2022 Rodney ..... G01V 11/00
11,512,587 B2 * 11/2022 Feddema ..... E21B 10/602
12,031,384 B2 * 7/2024 Chen ..... E21B 10/5673
12,203,357 B2 * 1/2025 Dunbar ..... E21B 47/08
2006/0065395 A1 * 3/2006 Snell ..... E21B 41/0078 175/45
2014/0326515 A1 * 11/2014 Shi ..... E21B 10/633 76/108.4
2024/0384646 A1 * 11/2024 Haugvaldstad ..... E21B 47/013

* cited by examiner

*Primary Examiner* — Aaron L Lembo

(57) ABSTRACT

A drill bit can include a bit body; a blade mountable to the bit body, where the blade includes pockets; a moveable cutter disposed in one of the pockets; and sensor circuitry that senses movement of the moveable cutter disposed in the one of the pockets to generate sensor data.

19 Claims, 21 Drawing Sheets

INSTRUMENTED MOVABLE DRILL BIT CUTTER

BACKGROUND

A resource field may be an accumulation, pool or group of pools of one or more resources (e.g., oil, gas, oil and gas) in a subsurface environment. A resource field may include at least one reservoir. A reservoir may be shaped in a manner that may trap hydrocarbons and may be covered by an impermeable or sealing rock. A bore may be drilled into an environment where the bore may be utilized to form a well that may be utilized in producing hydrocarbons from a reservoir.

A rig may be a system of components that may be operated to form a bore in an environment, to transport equipment into and out of a bore in an environment, etc. As an example, a rig may include a system that may be used to drill a bore and to acquire information about an environment, about drilling, etc. A resource field may be an onshore field, an offshore field or an on- and offshore field. A rig may include components for performing operations onshore and/or offshore. A rig may be, for example, vessel-based, offshore platform-based, onshore, etc.

Field planning may occur over one or more phases, which may include an exploration phase that aims to identify and assess an environment (e.g., a prospect, a play, etc.), which may include drilling of one or more bores (e.g., one or more exploratory wells, etc.). Other phases may include appraisal, development and production phases.

In various instances, material from drilling may be assessed, for example, to characterize a formation, etc. For example, consider assessment of cuttings as may be pieces of broken rock of a formation that may be transported from downhole to surface via circulation of drilling fluid. As an example, an instrumented movable drill bit cutter may provide for acquiring data for characterizing how a drill bit breaks rock to generate cuttings. In such an example, one or more types of field operations, such as, for example, drilling, may be improved.

SUMMARY

A drill bit can include a bit body; a blade mountable to the bit body, where the blade includes pockets; a moveable cutter disposed in one of the pockets; and sensor circuitry that senses movement of the moveable cutter disposed in the one of the pockets to generate sensor data. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations may be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
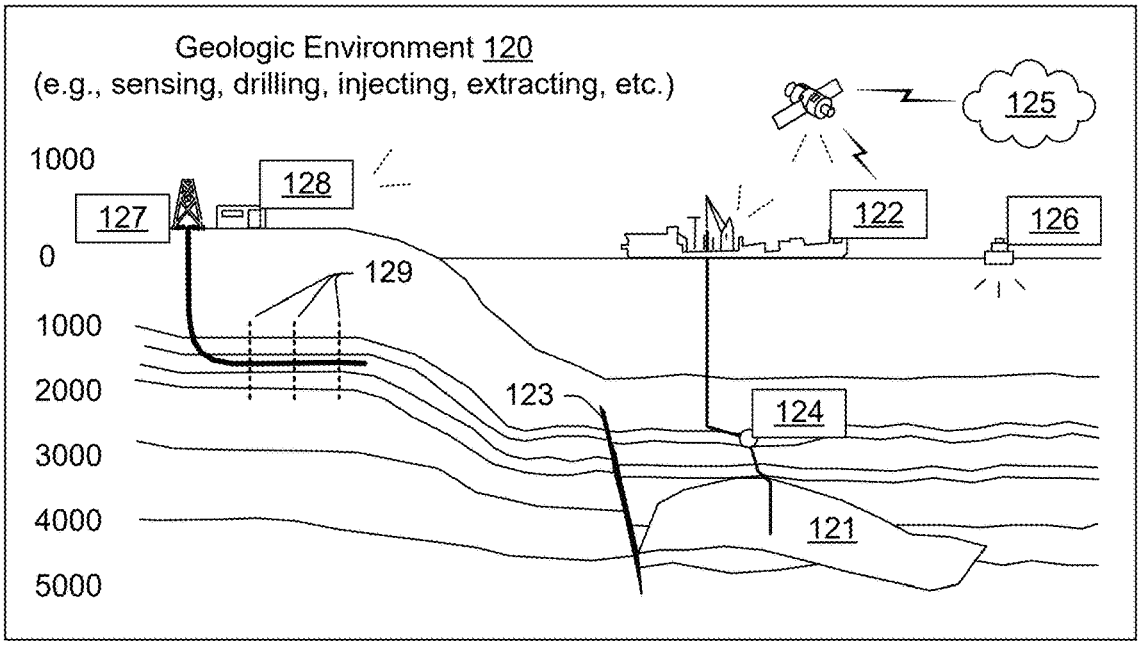
FIG. 1 illustrates examples of equipment in a geologic environment.
Figure 1:
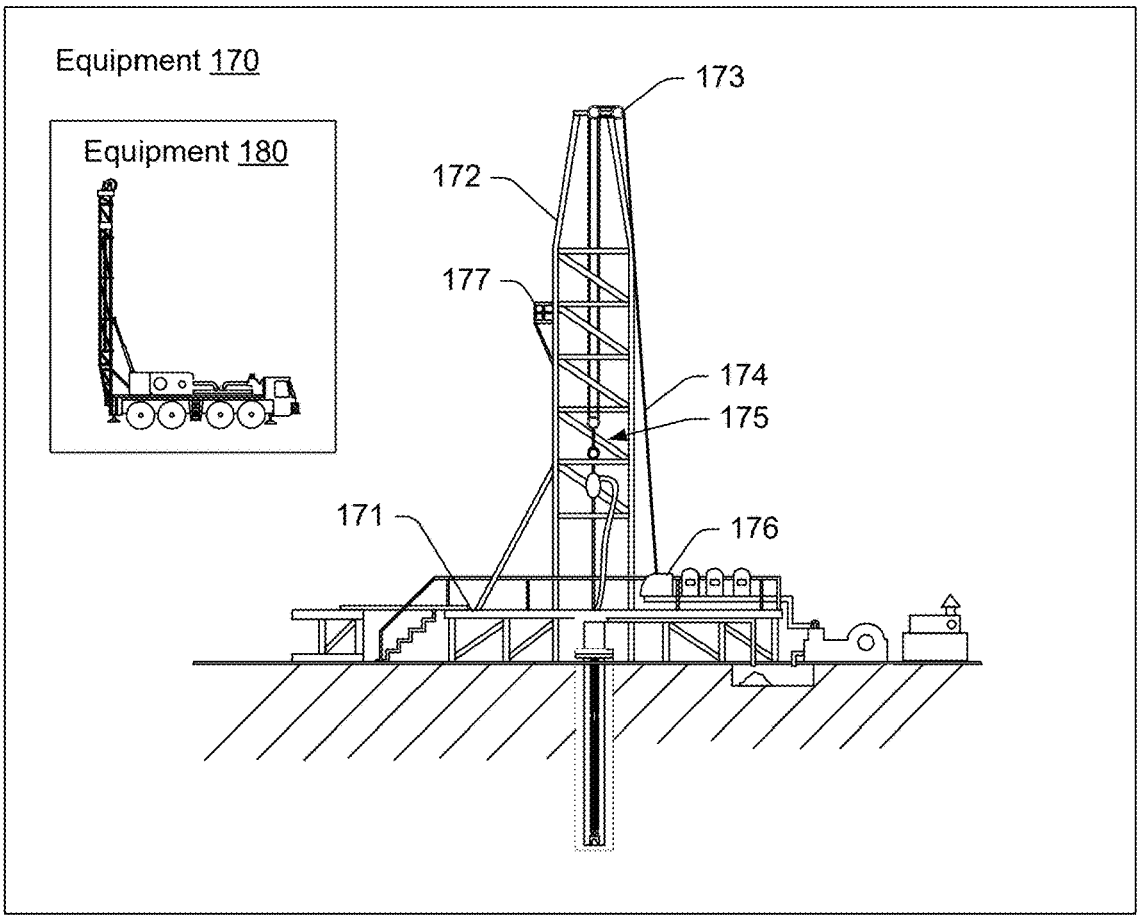

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick may be a structure used to support a crown block and a traveling block operatively coupled to the crown block at least in part via the line. A derrick may be pyramidal in shape and offer a suitable strength-to-weight ratio. A derrick may be movable as a unit or in a piece-by-piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line may cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block may include a set of pulleys (e.g., sheaves) that may be located at or near a top of a derrick or a mast, over which line is threaded. A traveling block may include a set of sheaves that may be moved up and down in a derrick or a mast via line threaded in the set of sheaves of the traveling block and in the set of sheaves of a crown block. A crown block, a traveling block and a line may form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick may include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until a time at which it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that may be pulled out of a hole and/or placed or replaced in a hole. As an example, a pipe trip may be performed where a drill bit has dulled or has otherwise ceased to drill efficiently and is to be replaced.

Figure 2:
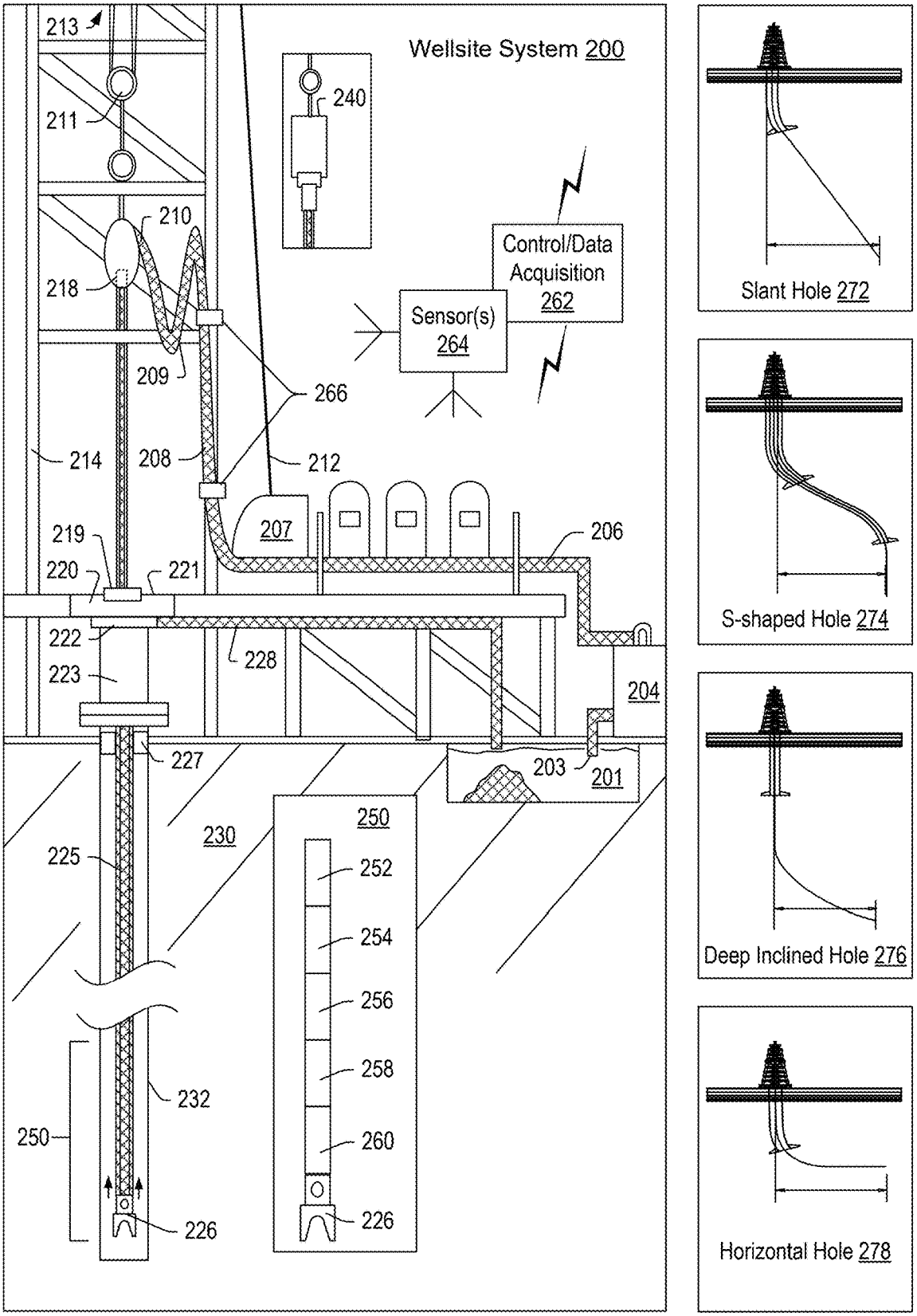
FIG. 2 illustrates examples of equipment and examples of hole types.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the platform 211 and the derrick 214 positioned over the borehole 232. As mentioned, the wellsite system 200 may include the rotary table 220 where the drillstring 225 pass through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such an example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254 (e.g., a LWD tool), a measuring-while-drilling (MWD) module 256 (e.g., a MWD tool), an optional module 258, a roto-steerable system (RSS) and/or motor 260, and the drill bit 226. Such components or modules may be referred to as tools where a drillstring may include a plurality of tools.

As to an RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM may be determined or estimated as a sum of the SRPM and the mud motor RPM, assuming the SRPM and the mud motor RPM are in the same direction.

As an example, a PDM mud motor may operate in a so-called sliding mode, when the drillstring is not rotated from the surface to drive a drill bit in a particular cutting direction. In such an example, a bit RPM may be determined or estimated based on the RPM of the mud motor. As an example, during a sliding mode, oscillation of a drillstring may be provided by surface equipment, for example, to oscillate the drillstring in a clockwise and a counter-clockwise direction, which may, for example, help to reduce risk of sticking, etc.

An RSS may drill directionally where there is continuous rotation from surface equipment, which may alleviate the sliding of a steerable motor (e.g., a PDM). An RSS may be deployed when drilling directionally (e.g., deviated, horizontal, or extended-reach wells). An RSS may aim to minimize interaction with a borehole wall, which may help to preserve borehole quality. An RSS may aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and may contain one or a plurality of selected types of logging tools. It will also be understood that more than one LWD and/or MWD module may be employed. Where the position of a module is mentioned, as an example, it may refer to a module at the position of the LWD module 254, the MWD module 256, etc. An LWD module may include capabilities for measuring, processing, and storing information, as well as for communicating with the surface equipment. In the illustrated example, the LWD module 254 may include a seismic measuring device.

The MWD module 256 may be housed in a suitable type of drill collar and may contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller may generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of one or more of an RSS, a downhole motor and/or a turbine. As to a motor, for example, a drillstring may include a positive displacement motor (PDM).

As an example, a system may be a steerable system and include equipment to perform a method such as geosteering. As an example, a steerable system may include a PDM or a turbine on a lower part of a drillstring which, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this term may refer to a portion of a drillstring that cannot be rotated or moved axially. As an example, a condition referred to as "differential sticking" may be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may have time and financial cost.

As an example, a sticking force may be a product of the differential pressure between the wellbore and the reservoir and the area that the differential pressure is acting upon. This means that a relatively low differential pressure (delta p) applied over a large working area may be just as effective in sticking pipe as may be a high differential pressure applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus.

Various types of data associated with field operations may be 1-D series data. For example, consider data as to one or more of a drilling system, downhole states, formation attributes, and surface mechanics being measured as single or multi-channel time series data.

Figure 3:
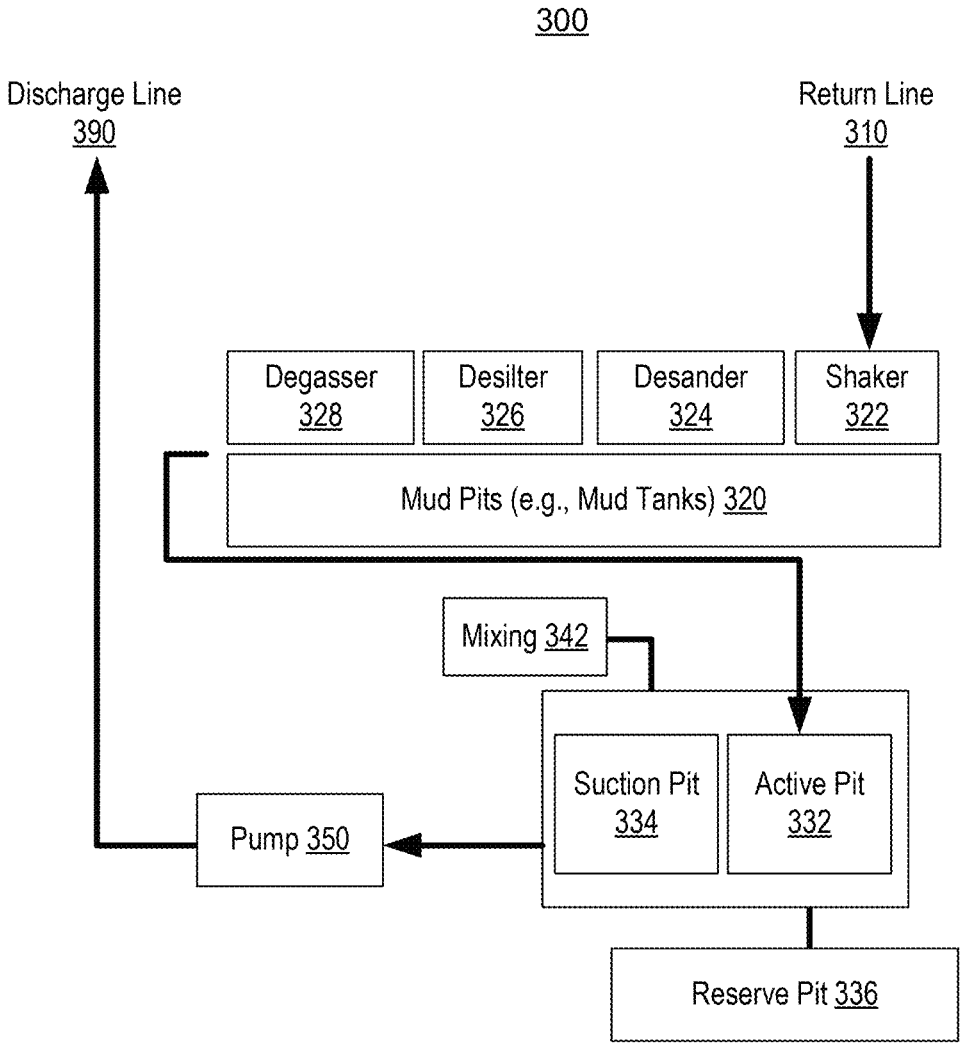
FIG. 3 illustrates an example of a system.

FIG. 3 shows an example of a drilling fluid system 300 that may aim to provide for various operations, which may include one or more of removing cuttings from a well, controlling formation pressures, suspending and releasing cutting, sealing permeable formations, maintaining wellbore stability, minimizing formation damage, cooling, lubricating and supporting a bit and drilling assembly, transmitting hydraulic energy to one or more downhole tools and/or a bit, ensuring adequate formation evaluation, controlling corrosion, facilitating cementing and completion, preventing gas hydrate formation, and minimizing impact on the environment.

As shown in the example of FIG. 3, the system 300 can include a return line 310 and a discharge line 390 (see also, e.g., the lines, pipes, hoses, etc., 206, 208, 209, 210, and 228 of FIG. 2). In the example of FIG. 3, the system 300 may include a shaker 322, a desander 324, a desilter 326, and a degasser 328 associated with various mud pits 320 (e.g., mud tanks) that can receive drilling fluid via the return line 310 and output processed drilling fluid to an active pit 332 that may be in fluid communication with a suction pit 334 and a reserve pit 336 where the suction pit 334 may be in fluid communication with a pump 350 that can pump drilling fluid to the discharge line 390. As an example, one or more mixing units 342 may be included, for example, for addition of one or more materials to the drilling fluid before it is pumped to the discharge line 390.

As an example, the system 300 may be utilized for one or more types of operations, which may include drilling, wireline, completions, blow out control, etc. As to completions, as an example, a cementing operation may include pumping and/or receiving of drilling fluid where cement may be positioned between casing and a borehole wall.

As an example, cuttings may be retrieved at surface, for example, using one or more of the components of the system 200 of FIG. 2, the system 300 of FIG. 3, etc. Cuttings can be produced as rock is broken by a drill bit advancing through a subsurface environment. As explained, cuttings may be carried to surface by drilling fluid (e.g., mud) circulating from one or more openings of a tool string such as, for example, openings of a drill bit of a drillstring. Drill cuttings may be separated from fluid using one or more types of equipment such as, for example, shale shakers, centrifuges, cyclone separators, etc. In cable-tool drilling, cuttings may be periodically bailed out of a bottom of a borehole. In auger drilling, cuttings may be carried to surface on auger flights.

Various different types of drill bits exist where two predominate types of drill bits are roller cone bits and fixed cutter (or rotary drag) bits. Most fixed cutter bit designs include blades angularly spaced about a bit face. The blades project radially outward from a bit body and form flow channels there between. Cutting elements may be grouped and mounted on several blades, for example, in radially extending rows.

Cutting elements disposed on the blades of a fixed cutter bit can be formed of extremely hard material. As an example, for a fixed cutter bit, each cutting element may include an elongate and generally cylindrical tungsten carbide substrate that is received and secured in a pocket formed in a surface of a blade. As an example, cutting elements may include a hard cutting layer of polycrystalline diamond (PCD) or other superabrasive materials such as thermally stable diamond or polycrystalline cubic boron nitride.

Figure 4:
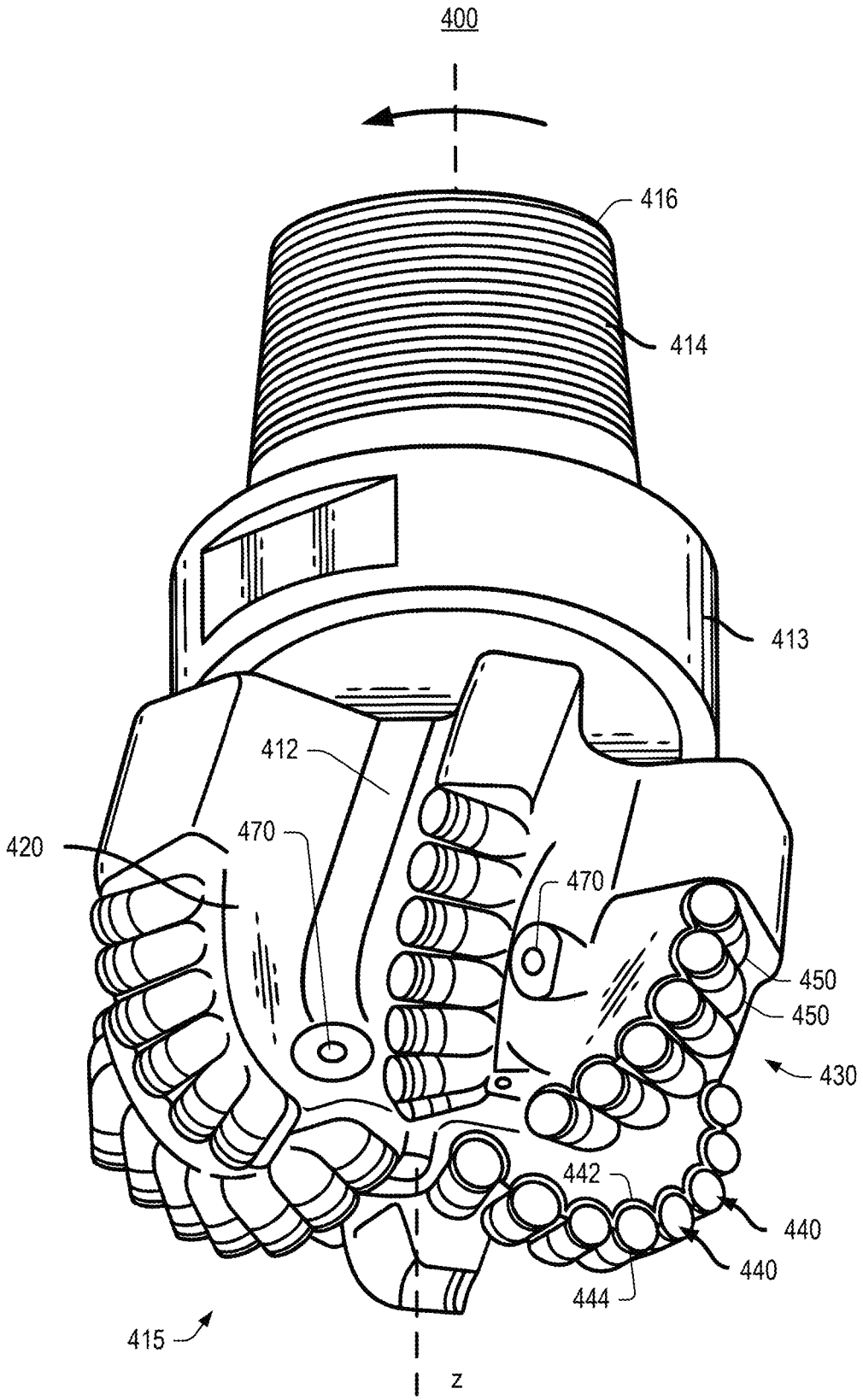
FIG. 4 illustrates an example of a drill bit.

FIG. 4 shows an example of a bit 400 suitable for drilling through formations of rock to form a borehole. The bit 400 can include a bit body 412, a shank 413, and a threaded connection or pin 414 for connecting the bit 400 to a drillstring employed to rotate the bit 400 to drill a borehole. A bit face 420 can support a cutting structure 415 and be formed on an end of the bit 400 that is opposite pin end 416. The bit 400 may further be defined according to a central axis z about which bit 400 can rotate in a cutting direction represented by arrow.

As shown, the cutting structure 415 can be provided on the face 420 of bit 400. The cutting structure 415 can include angularly spaced-apart blades 430 that extend from the bit face 420. While six blades 430 are shown, the number of blades and blade types may vary (e.g., consider more or less blades, primary blades, secondary blades, etc.). As an example, a secondary blade of a bit may refer to a blade that begins at some distance from a bit axis and extends generally radially along a bit face to a periphery of the bit. As an example, a drill bit may include various features such as, for example, gage pads, junk slots, etc.

As an example, a blade may include a blade top 442 for mounting cutting elements 440. Each of the cutting elements 440 may include a respective cutting face 444. As an example, the blades 430 can include pockets 450 where each of the cutting elements 440 may be mounted in a corresponding one of the pockets 450 as formed in blade tops 442. The cutting elements 440 may be arranged adjacent one another in a radially extending row proximal to a leading edge of each of the blades 430.

As explained, the cutting elements 440 can be embedded in the pockets 450 of the blades 430 where the cutting elements 440 can break rock as the drill bit 400 is rotated on a bottom surface of a borehole. As explained, the cutting elements 440 may be fixed cutter elements that may include PDC or other specially manufactured cutter material.

As an example, the cutting elements 440 may be rotatable cutter elements (e.g., rotatable cutters). For example, a cutting element may include a sleeve portion where a cutting face portion is coupled to a shaft portion received by a bore of the sleeve portion. As an example, one or more cutting elements of the ENDURO 360 family of cutting elements may be utilized (SLB, Houston, Texas). A rotatable cutter may provide for reduction of mechanical and/or thermal effects that may promote wear and/or chipping of a cutter. For example, a fixed cutter is set within a pocket in a manner whereby the fixed cutter is not rotating such that a particular portion of the fixed cutter may engage a formation and wear and/or chip due to mechanical and/or thermal effects. A rotatable cutter may increase durability by helping to ensure that a portion of the rotatable cutter such as an edge that makes contact with a formation is continually refreshed such that the edge may stay sharper longer. As to an edge, consider a perimeter of a cutting face that may be substantially circular and able to rotate by 360 degrees about a longitudinal axis of a rotatable cutter such that the entire perimeter may be available at times to contact rock and break the rock during drilling. As an example, rotating action of a rotatable cutter may improve thermal dissipation, which may help to reduce concentrated heat buildup. Heat buildup may occur in an asymmetric manner, which may cause heterogeneity in temperature distributions within a cutter. As a cutter may be characterized at least in part by thermal properties (e.g., thermal conductivity, coefficient of expansion, etc.), heterogeneity in temperature may increase stress or impact stress handling ability of a cutter. By rotating a cutter, heat energy caused by a portion of a cutter being a main portion interacting with rock may be dissipated as that portion rotates to a position where its interaction with rock is reduced and where another portion of the cutter rotates to become the main portion interacting with rock.

As an example, a cutter may be characterized by various dimensions such as, for example, a face dimension. As an example, a face dimension may be a diameter of a cylindrical cutter. For example, consider a diameter in a range from approximately 3 mm to approximately 30 mm or more. As to the ENDURO 360 (e.g., ENDUROBLADE 360) cutter elements, consider sizes of 13 mm, 16 mm, 19 mm, etc. As explained, a rotatable cutter may provide for increased strength and durability, which may provide for increases in run length and/or penetration rate (e.g., ROP).

As an example, a drill bit may include a number of cutters where the cutters may include fixed cutters and/or rotatable cutters. As an example, number, type and/or placement of cutters may be selected to provide desired drill bit behavior, such as, for example, improved durability in one or more high-wear areas of a drill bit.

As explained, drilling fluid (e.g., mud) can flow through passages of a drill bit to help lubricate the drill bit and to carry away cuttings. In the example of FIG. 4, the drill bit 400 is shown as including various openings 470, which may be referred to as mud ports. As explained, hole cleaning can depend on an ability of a drilling fluid to transport and suspend drilled cuttings. In various instances, inadequate hole cleaning may diminish drilling performance and/or damage one or more portions of a drill bit.

As an example, a drill bit can include one or more sensors that can acquire measurements, which may be in the form of electrical signals, magnetic signals, electro-magnetic signals, optical signals, etc. For example, consider a drill bit that includes a cutter that is disposed in a pocket of a blade where motion of the cutter can be sensed. In such an example, the motion of the cutter may be in one or more dimensions of one or more coordinate systems. For example, consider rotational motion in a cylindrical coordinate system with r, z, and theta coordinates where rotation may be in the theta direction (e.g., in a clockwise and/or a counter-clockwise direction). In such an example, motion may be in the z coordinate direction, for example, where a cutter may move inwardly and/or outward with respect to its pocket. As an example, motion may be in the r coordinate direction, for example, where a cutter may move in a manner that may tilt the cutter with respect to a z coordinate direction such as a longitudinal cutter axis. As an example, cutter motion may be characterized using one or more spatial coordinates and/or time. For example, consider motion tracked with respect to time in one or more spatial coordinate directions.

As explained, motion may be minimal or may be more substantial. For example, minimal motion in a z coordinate direction may be less than one millimeter and may be registered akin to strain of a strain gauge. As to more substantial motion, consider rotation of a cutter in a pocket where the rotation of the cutter may be more than several degrees.

As an example, a cutter may be configured to be translatable in a pocket such that translation may occur responsive to force applied to the cutter where one or more types of circuitry may provide for sensing of such translation. As an example, a cutter may be biased such as, for example, being spring-loaded, such that a cutter may move axially when force is applied and/or when force is relieved, which may be characterized at least in part by a spring constant of a biasing member or biasing members.

As an example, a cutter may be configured to be rotatable within a pocket such that rotation may be sensed using one or more types of circuitry. In such an example, forces acting upon a cutter may cause the cutter to rotate in a clockwise direction and/or in a counter-clockwise direction. In such an example, circuitry may include one or more of magnetic, optical, electrical, electro-magnetic, etc., types of circuitry. As an example, orientation circuitry may be utilized that may sense orientation of a cutter with respect to a pocket. For example, consider utilization of a pattern on one or more surfaces where rotation causes the pattern to be oriented differently with respect to a sensor or sensors.

As an example, one or more Hall sensors may be utilized. A Hall sensor may be utilized for one or more of proximity sensing, positioning, speed detection, current sensing, etc. As to proximity, an axial distance between components of a Hall sensor assembly may provide for changes in Hall sensor signal. As to rotational position, a rotational distance between components of a Hall sensor may provide for changes in Hall sensor signal.

As an example, one or more Hall sensors may provide for detection of one or more magnetic fields, which may be due to material within a formation, an induced magnetic field, the Earth's magnetic field, etc. As an example, where a drill bit includes one or more Hall sensors, when the drill bit is stationary, the one or more Hall sensors may provide for detection of a direction of Earth's magnetic field and/or one or more magnetic anomalies. In such an example, signals from drill bit circuitry may provide for orientation determinations as to a drill bit with respect to an external magnetic field. As an example, a Hall sensor may operate as a type of compass. As an example, where interference from an external magnetic field is to be reduced, a drill bit may include circuitry that may be shielded and/or one or more signal reduction techniques may be utilized to improve signal-to-noise ratio (SNR).

As an example, an optical-based sensor may be utilized where, for example, an optical pattern may provide for position sensing. For example, consider a pattern that includes regions that respond differently to illumination, for example, by reflecting, transmitting, etc., illumination differently. As an example, an optical-based sensor may provide for wavelength and/or phase-based sensing.

As an example, a sensor may include a transmitter and a receiver where the transmitter may issue EM radiation that may be received by the receiver where a reception signal may depend on position, etc. As an example, a sensor may include one or more antennas and/or one or more energy storage devices. For example, consider a bidirectional antenna that can transmit energy to another bidirectional antenna that may be coupled to an energy storage device such as a capacitor where the capacitor may release energy such that the transfer of energy is reversed whereby such energy may be analyzed to determine a positional relationship between the antennas. In such an example, consider in-phase and out-of-phase transmissions that may depend on orientation of one antenna with respect to another antenna.

As explained, mechanical positions within an electromagnetic system may be measured with a Hall effect sensor, an optical position encoder (e.g., absolute and incremental encoders), an induced voltage (e.g., by moving an amount of a metalcore inserted into a transformer), etc. In various instances, a photo-sensitive technique may more readily provide for determining an absolute position when compared to a Hall effect-based technique.

As an example, a drill bit can include rotating cutting elements where one or more of the rotating cutting elements may be paired with circuitry that can acquire one or more types of measurements such as, for example, a measurement of angular frequency. In such an example, data may be obtained that includes information associated with rock properties and the nature of a rock-cutter interface. Such data may be utilized to make inferences about a type of formation that is in contact with a drill bit, abrasive properties of the formation, condition of one or more cutters, condition of the drill bit, etc. As an example, data may provide for identification of one or more bed boundaries, for example, as to when a drill bit may contact and/or cross a bed boundary. In such an example, a boundary may be detectable in an expedited manner, which may be faster than via detection by one or more LWD tools (e.g., consider tools that may measure formation properties using radiation, etc.). As an example, data may provide for determining a size distribution of cuttings and, for example, issuing one or more notifications (e.g., a flag, etc.) when one or more conditions change (e.g., via one or more criteria, etc.).

As an example, when a drill bit measurement is combined with telemetry, and acquired data transmitted to surface, one or more drilling parameters may be adjusted (e.g., tuned, etc.), which may provide for optimization of a drilling process.

As an example, a drill bit may include a network where components may be distributed within or on the drill bit and operatively coupled. For example, consider a number of sensors paired with a corresponding number of cutters (e.g., cutting elements) where a network may provide for receipt of sensor data, sensor control, etc. As an example, a network may include a host that coordinates acquisition of sensor data and/or timings of sensor operations. As an example, a network may include circuitry and components for optical, wired and/or wireless connections. As an example, a network may provide for supply of power to one or more sensors, which may be provided in a manner that conserves power (e.g., where a downhole power supply may be limited). As an example, a network of sensors may be arranged such that one or more types of differential measurements may be made such as, for example, differential measurements between cutters such that changes occurring on one cutter may be distinguished from one or more types of bit scale phenomena.

As explained, one or more Hall effect sensors may be included in a drill bit, which may, for example, be set within a stationary reference frame (e.g., a reference frame of a drill bit blade) relative to one or more magnets which may be coupled to a pocket face of a rotating cutter, which when a rock face of the rotating cutter is in contact with a formation during drilling, can provide for generation of output via a Hall effect whereby the output changes dynamically responsive to cutter-rock interaction.

Figure 5:
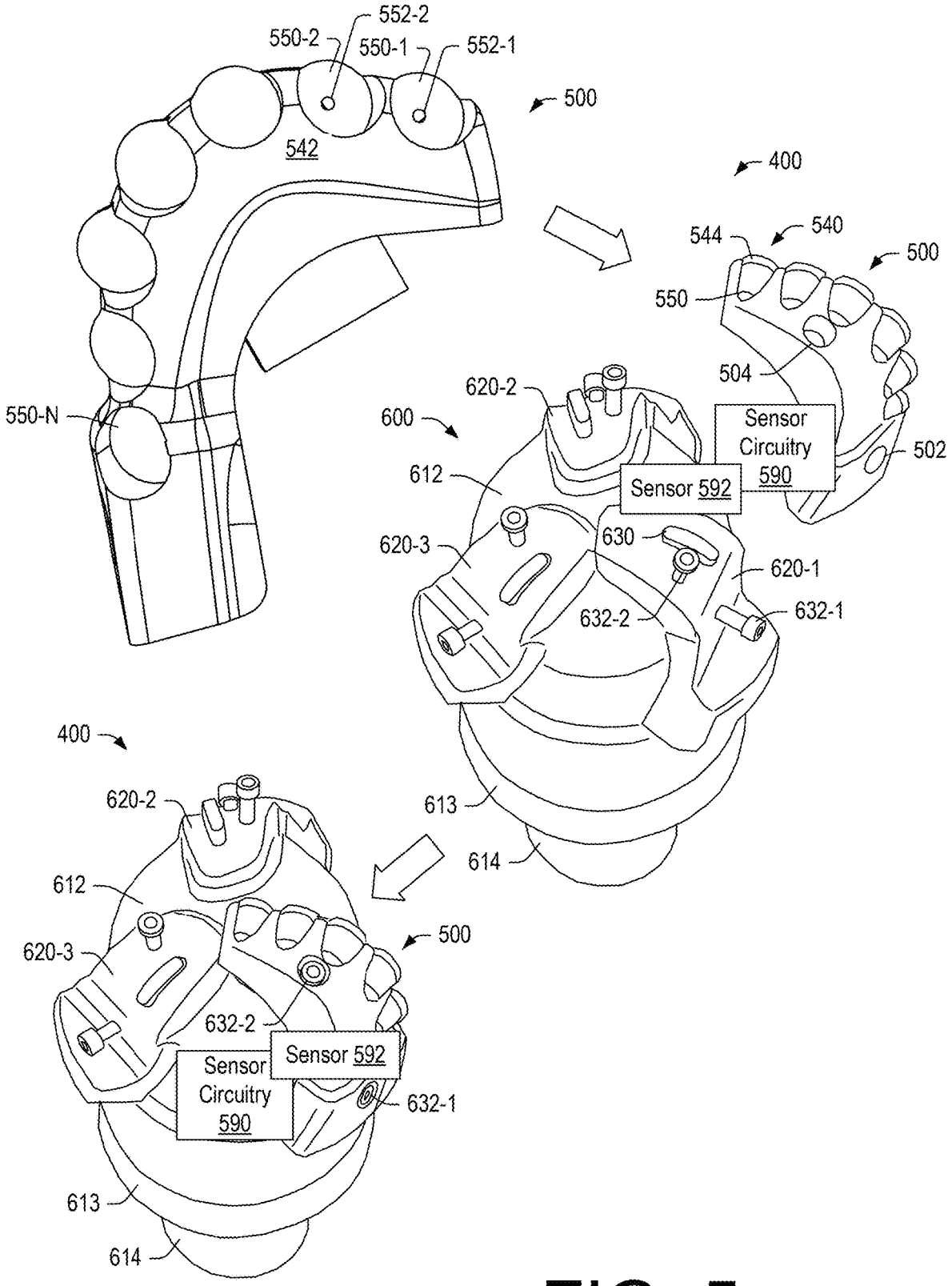
FIG. 5 illustrates an example of a blade and an example of a drill bit.

FIG. 5 shows a perspective view of an example of a blade 500 that may be part of a drill bit where the blade 500 includes a blade top 542 with a number of pockets 550-1, 550-2, . . . , 550-N. As shown, one or more of the pockets 550-1, 550-2, . . . , 550-N, may include openings such as, for example, the openings 552-1 and 552-2, which may provide for connecting one or more sensors to a host (e.g., sensor circuitry to host circuitry). As explained, a blade may include a network and/or a drill bit may include a network. As an example, blades may provide sub-networks that may form or are part of a drill bit network. While the blade 500 includes seven pockets, a blade may include a lesser or a greater number of pockets.

FIG. 5 also shows an example of a drill bit 400 that includes an example of a bit body 600 and an example of the blade 500 that can be coupled to the bit body 600 using various features. As indicated by large arrows, a method of assembly of a drill bit may include selecting a blade, positioning the blade with respect to a bit body and securing the blade to the bit body.

In the example of FIG. 5, the bit body 600 can include a bit body surface 612, a shank 613, and a threaded connection or pin 614. As shown, the bit body surface 612 can include a number of mounts 620-1, 620-2, and 620-3 where each of the mounts 620-1, 620-2, and 620-3 can include and/or provide for mounting features such as, for example, a key 630 and bolts 632-1 and 632-2. As an example, one or more rods may be utilized, for example, using one or more bores, which may thereby function as a key-keyway pair to secure a blade to a mount.

As shown, the blade 500 can include one or more bores 502 and 504 for coupling to one of the mounts 620-1, 620-2, and 620-3, for example, using one or more of the bolts 632-1 and 632-2, which may be secured in threaded bores. As an example, the blade 500 may include a keyway that can receive the key 630 such that a key-keyway pair provide for proper locating and/or stability; noting that the key 630 may be a component that can be received in respective keyways and/or the bit body 600 may include a keyway for receipt of a key of the blade 500. As shown, the blade 500 can include a number of cutters 540 as may be received by a number of respective pockets 550 where each of the cutters 540 may include a corresponding cutting surface 544. As an example, one or more of the cutters 540 may be a moveable cutter, which may be, for example, a rotatable cutter.

As shown in FIG. 5, the drill bit 400 can include one or more instances of sensor circuitry 590 where, for example, the sensor circuitry 590 may include one or more sensors 592.

As explained, a kit may include various components, units, etc. For example, consider a kit that may include various blades that may differ with respect to size, shape, cutters, and/or sensors and/or other circuitry. As explained, a blade may be coupled to a bit body using one or more features, which may include, for example, locating features and/or securing features. As an example, one or more key-keyway pairs may be provided, which may help to stabilize a blade positionally. For example, consider features that may provide for anti-rotation, anti-translation, etc., types of positional stability.

Figure 6:
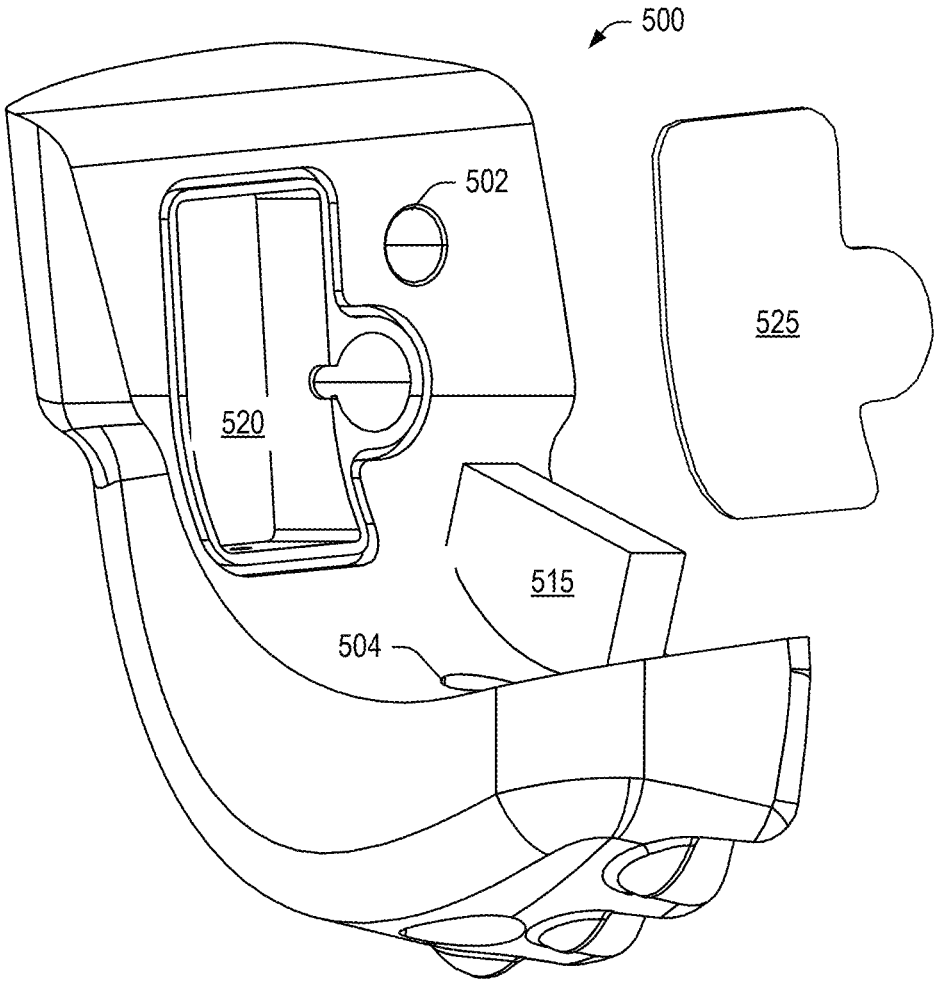
FIG. 6 illustrates an example of a blade.

FIG. 6 shows another perspective view of the blade 500 where the blade 500 may include the one or more bores 502 and 504, a mounting key 515, and a recess 520. As an example, the mounting key 515 may be shaped and sized to be received at least in part by a keyway of a bit body such that the blade 500 can be rigidly attached to the bit body. As an example, one or more bolts may be received in one or more corresponding bores (see, e.g., the bores 502 and 504) such that the blade 500 is securely attached to a bit body. As an example, the recess 520 may be fit with a recess cover 525. In such an example, upon attaching the blade 500 to a bit body, the recess 520 may be protected. For example, the recess cover 525 may be disposed between the blade 500 and the bit body in a manner by which the recess cover 525 can seal and protect circuitry disposed in the recess 520. In such an example, the seal may be a hermetic seal that hinders flow of fluid into the recess 520.

Figure 7:
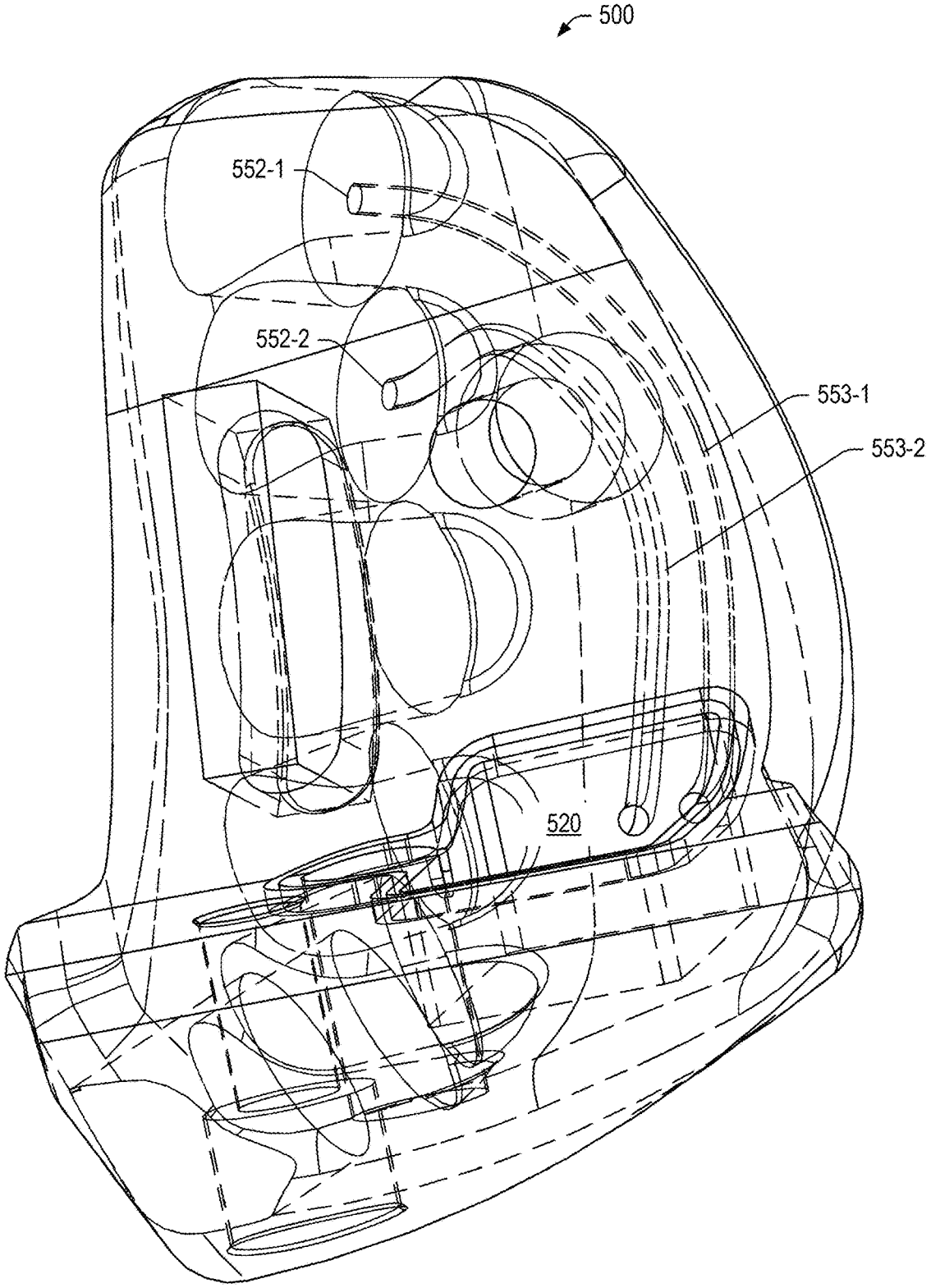
FIG. 7 illustrates an example of a blade.

FIG. 7 shows an approximate see-through view of an example of the blade 500 where the openings 552-1 and 552-2 are passage openings for passages 553-1 and 553-2 that extend to the recess 520. In such an example, the passages 553-1 and 553-2 may provide for routing of wire, optical fiber, etc. As an example, the blade 500 may be constructed from a material that may be conductive or non-conductive. As an example, a blade may be constructed from a conductive material that may serve as a ground for one or more electrical circuits. In such an example, a number of wires may be reduced, which may provide for a reduction in possible points of failure of an instrumented drill bit.

Figure 8:
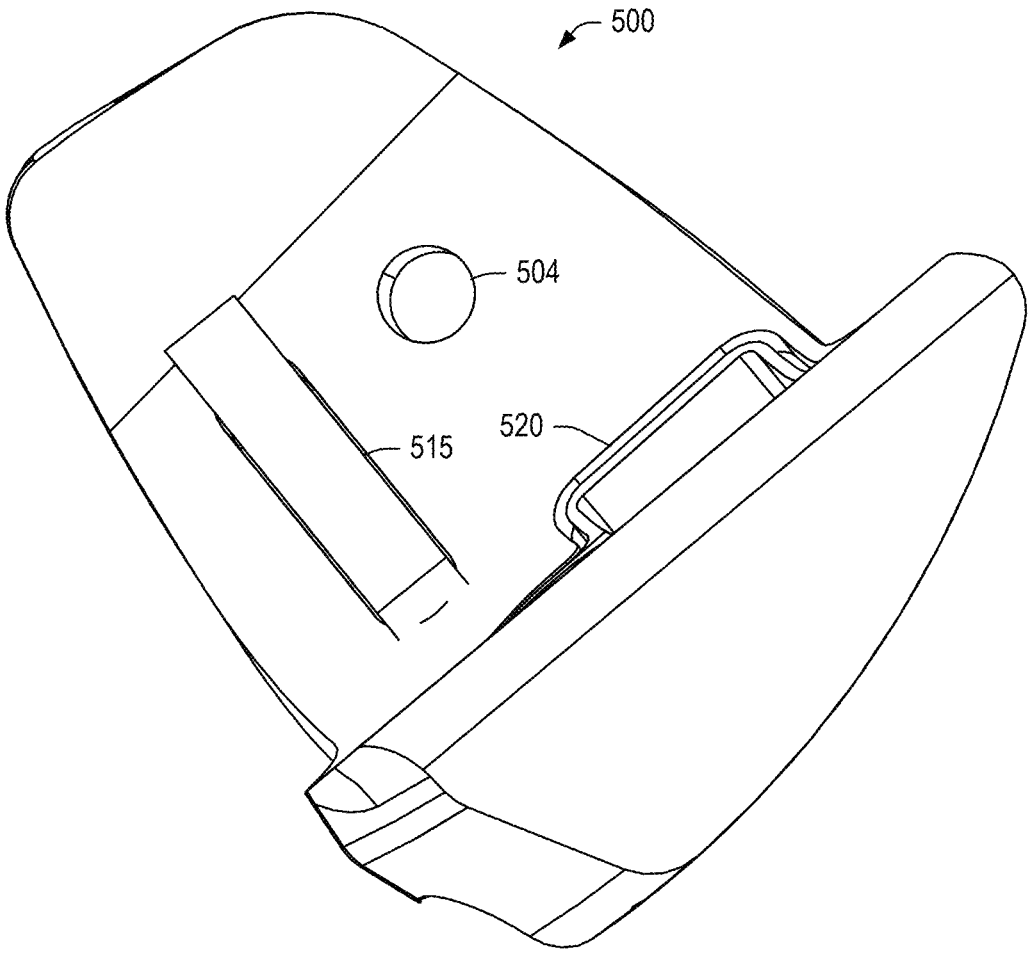
FIG. 8 illustrates an example of a blade.

FIG. 8 shows another perspective view of the blade 500 where a portion of the recess 520 is visible along with the mounting key 515 and one of the bores 504.

Figure 9:
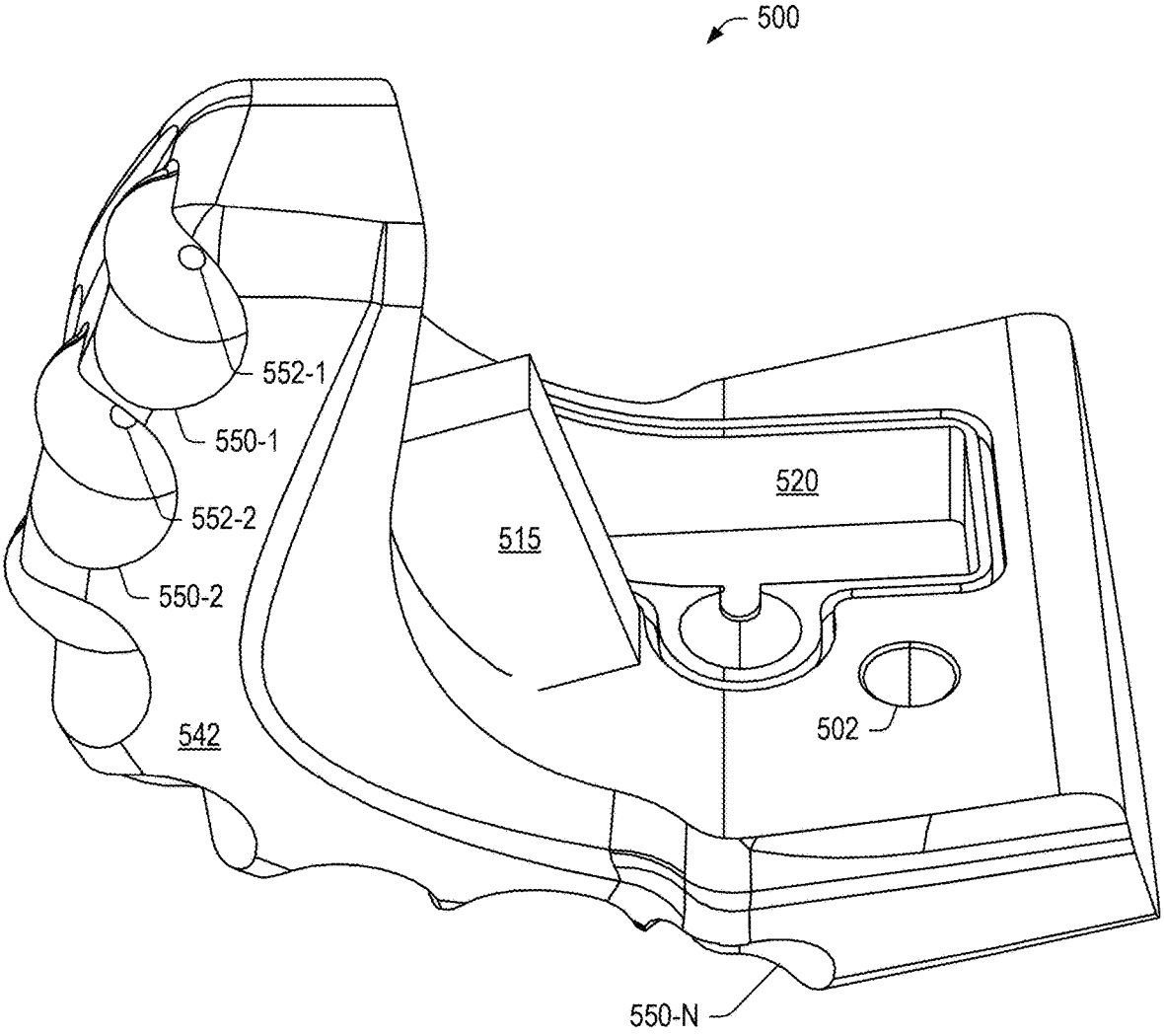
FIG. 9 illustrates an example of a blade.

FIG. 9 shows another perspective view of the blade 500 where various pockets 550-1, 550-2, . . . , 550-N are visible in the blade top 542 along with the mounting key 515, the recess 520, and the bore 502.

Figure 10:
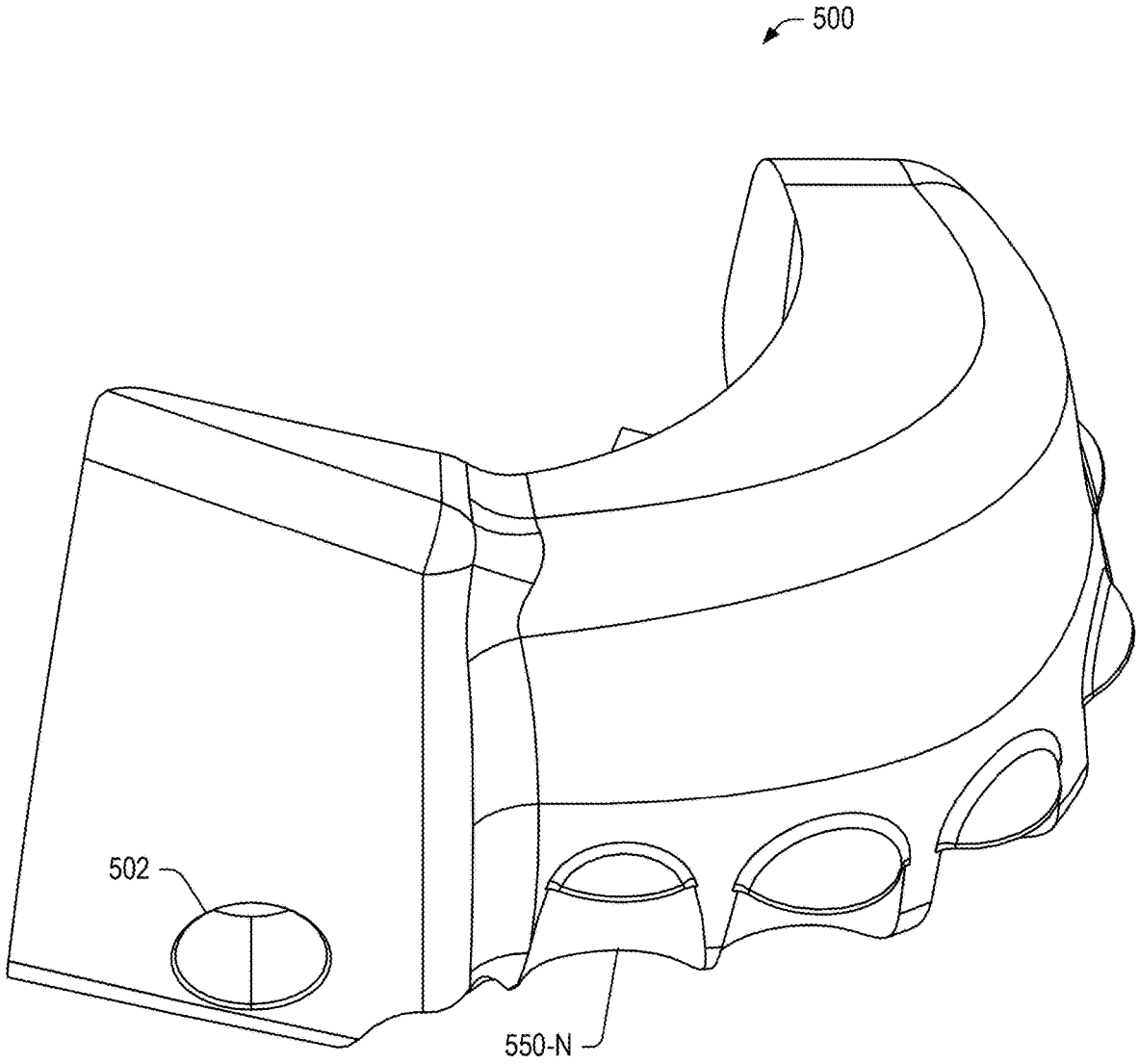
FIG. 10 illustrates an example of a blade.

FIG. 10 shows another perspective view of the blade 500 where the bore 502 is visible, which may be proximate to the recess 520. As explained, the blade 500 may be mounted to a bit body where a bolt or other type of component may be received at least in part in the bore 502 to attach the blade 500 to the bit body. As explained, such an approach may provide for protecting circuitry and/or other components disposed in a recess or recesses.

Figure 11:
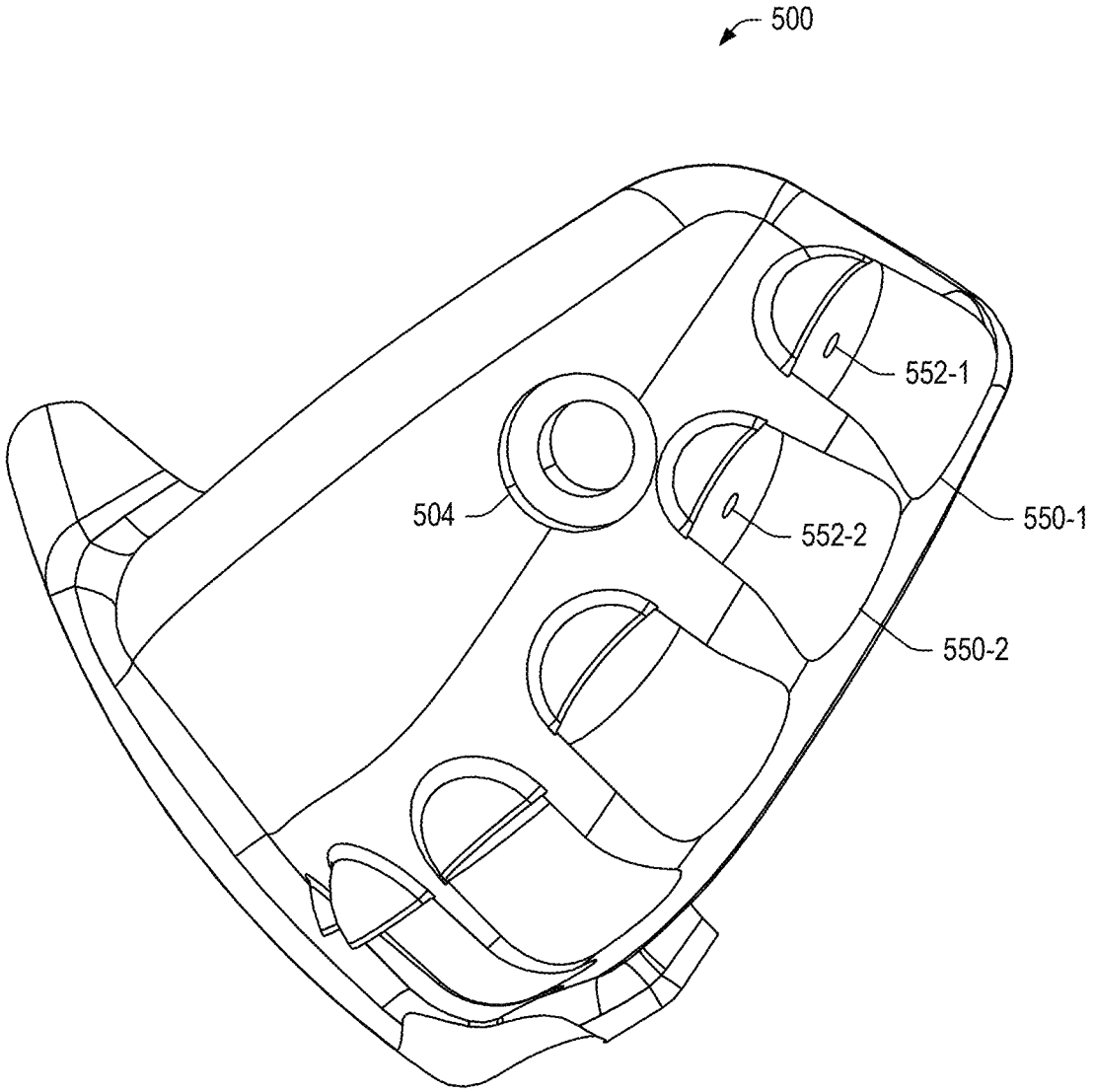
FIG. 11 illustrates an example of a blade.

FIG. 11 shows another perspective view of the blade 500 where the bore 504 is visible along with various pockets 550-1, 550-2, etc.

Figure 12:
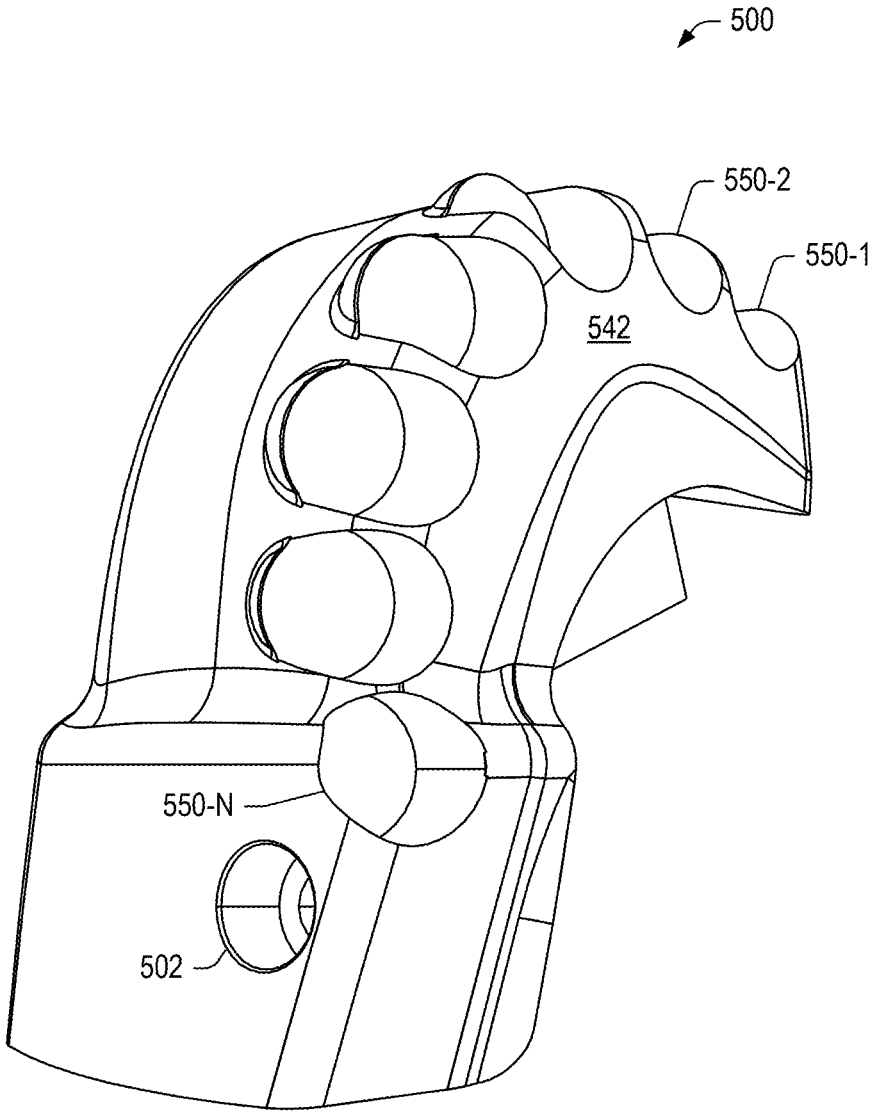
FIG. 12 illustrates an example of a blade.

FIG. 12 shows another perspective view of the blade 500 where the bore 502 is visible along with various pockets 550-1, 550-2, . . . , 550-N as located with respect to the blade top 542.

As an example, a blade and/or one or more other bit features may be described with respect to one or more coordinate systems. For example, a bit may be described with respect to a Cartesian coordinate system located at the center of mass of the bit where x, y, and z axes may be orthogonal with the z axis being a longitudinal axis. As an example, a cutter may be described using one or more coordinate systems. For example, consider a Cartesian coordinate system may be defined with its origin on a cutter face, with a z axis being a longitudinal axis. As an example, one or more cylindrical, spherical and/or other coordinate systems may be utilized. For example, a cutter and a cutter pocket may be defined using one or more cylindrical coordinate systems (e.g., using r, z, and theta coordinates).

Figure 13:
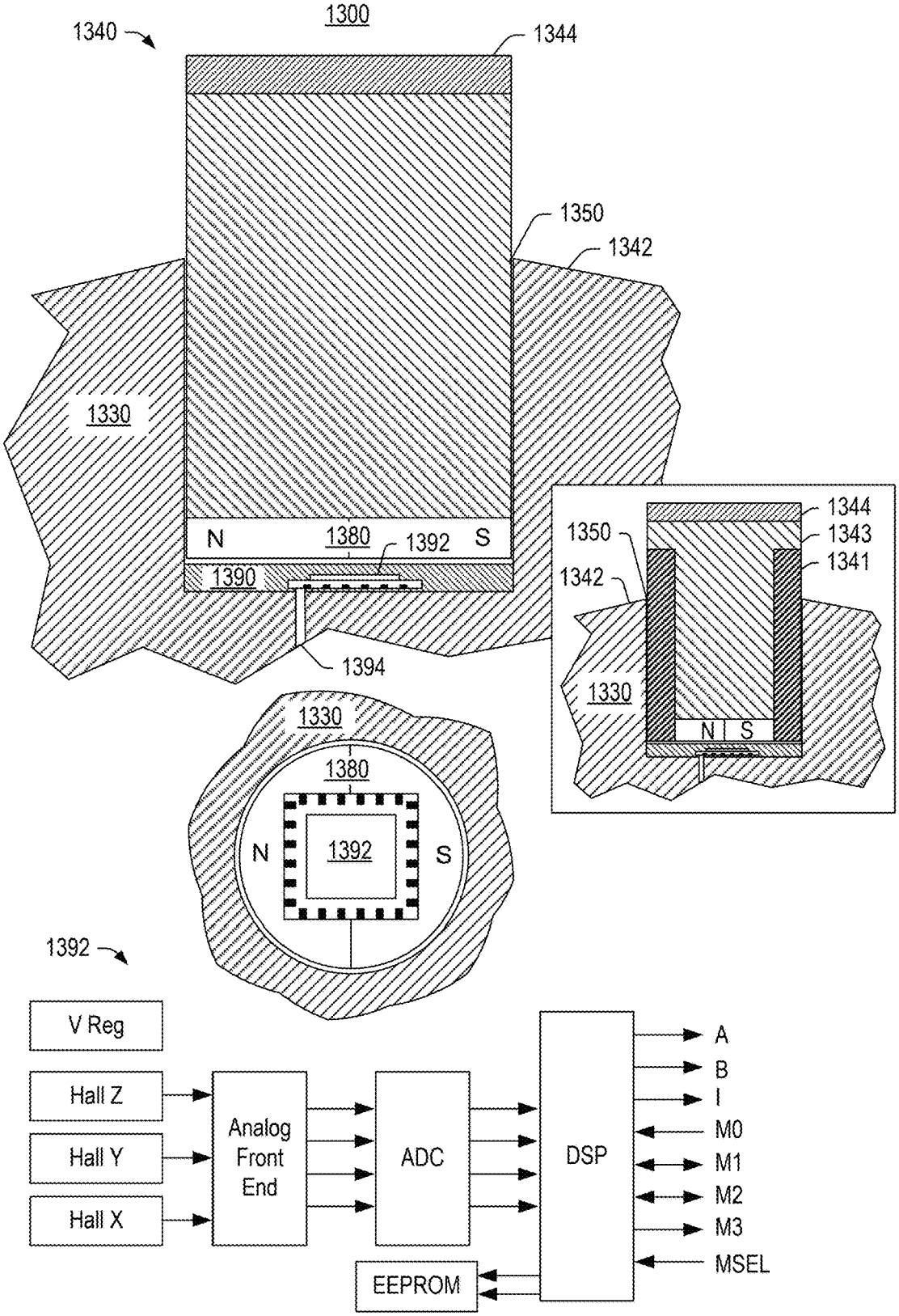
FIG. 13 illustrates an example of an assembly.

FIG. 13 shows an example of an assembly 1300 that includes a cutter 1340 disposed in a pocket 1350 in a blade top 1342 of a blade 1330 where the cutter 1340 includes a face 1344 (e.g., a cutting face) and one or more magnets 1380 at an end opposite the face 1344 (e.g., a pocket face). As shown, the assembly 1300 can include a sensor unit 1390 that can include circuitry 1392 where a passage 1394 may provide for routing of one or more of a wire and an optical fiber to the circuitry 1392. FIG. 13 also shows an inset example where the cutter 1340 includes a sleeve portion 1341 and a rotatable post portion 1343 supported by the sleeve portion 1341. As an example, a cutter may be fixed or may be rotatable in a pocket of a blade. As an example, a rotatable cutter may be rotatable using one or more techniques, technologies, etc.

In the example of FIG. 13, the one or more magnets 1380 may be moveable in one or more directions with respect to the circuitry 1392 of the sensor unit 1390. As shown, the circuitry 1392 may include a voltage regulator, HallI effect components for one or more directions (e.g., X, Y, and Z), an analog front end, an analog to digital converter (ADC), a digital signal processor (DSP) and an EEPROM (e.g., a type of non-volatile ROM that enables individual bytes of data to be erased and reprogrammed). As an example, the DSP may operate using internal memory and/or external memory where, for example, the DSP may be operable according to one or more techniques to acquire measurements and to output data.

As an example, the circuitry 1392 may include one or more features of the BROADCOM AET-9922 circuitry, which provides a 10-bit to 18-bit programmable angular magnetic encoder integrated circuit (IC) for on- and off-axis applications. In the example of FIG. 13, the Hall effect component labeled "Z" may be an on-axis component that may provide for measurement of movements along a longitudinal axis of the cutter 1340 (e.g., up and/or down in the pocket 1350).

In the example of FIG. 13, the one or more magnets 1380 may be or include one or more two-pole magnets. As an example, a two-pole magnet may provide for interaction with one or more Hall effect components such that, for example, when the two-pole magnet moves, its corresponding magnetic field moves in the presence of the one or more Hall effect components. The circuitry 1392 may provide for real-time measurement such as the angular position of the cutter 1340 in the pocket 1350 of the blade 1330. As an example, the circuitry 1392 may provide for output via SSI, SPI, PWM, etc. As an example, such output may be directed to one or more wires, optical fibers, wireless circuits, etc., for transmission. As an example, transmission may be via wired pipe, optical fiber pipe, mud-pulses, etc.

As explained, the drill bit 400 of FIG. 5 may include the sensor circuitry 590, which may be provided as one or more instances of the sensor circuitry 590. As an example, the sensor circuitry 590 may include one or more features of the circuitry 1392 of FIG. 13.

Figure 14:
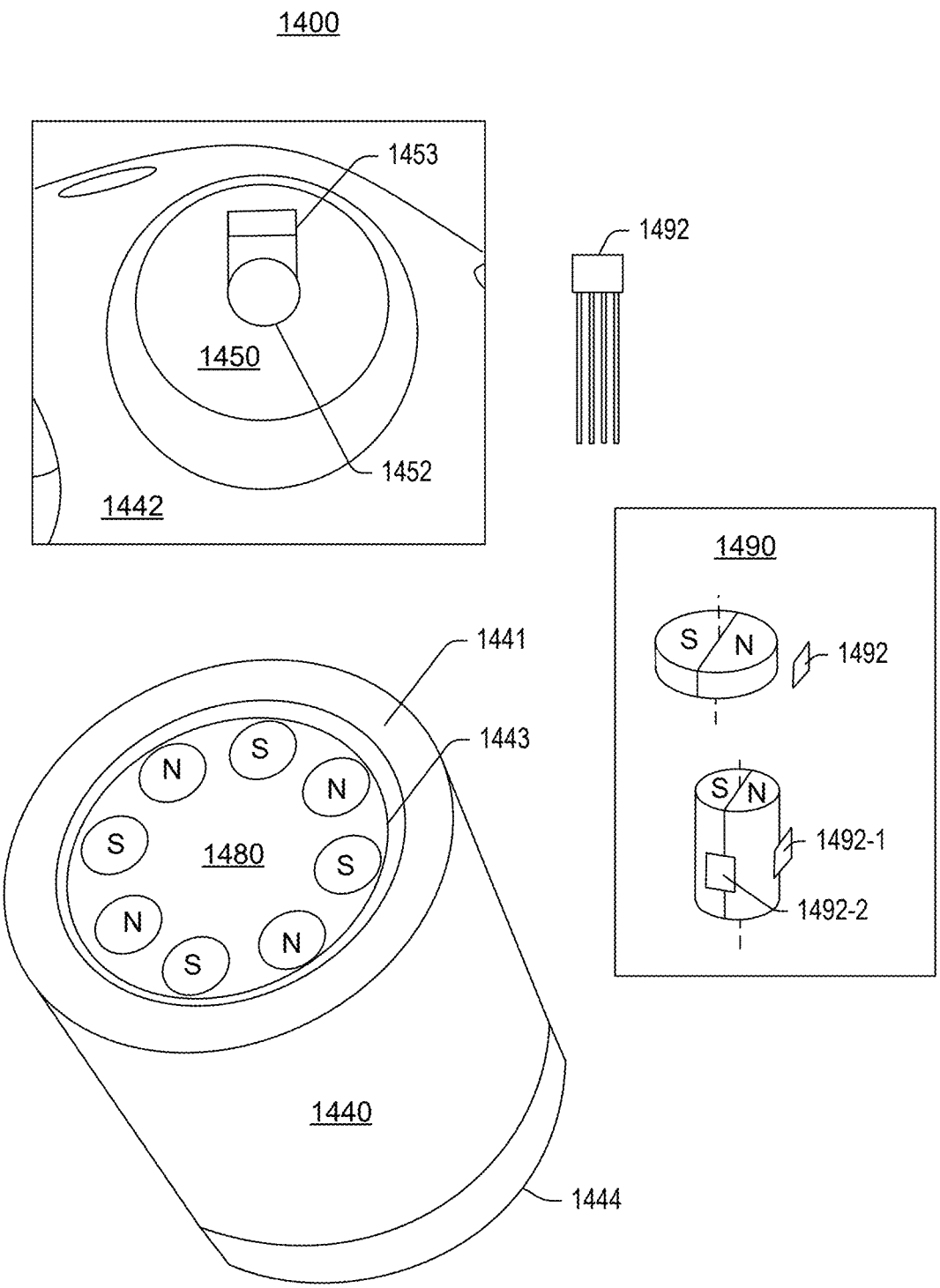
FIG. 14 illustrates an example of an assembly.

FIG. 14 shows an example of an assembly 1400 that can include a pocket 1450 in a blade top 1442 where the pocket 1450 may include an opening 1452 that may be in communication with a passage and where a recess 1453 for circuitry 1492 may be disposed adjacent or proximate to the opening 1452.

As an example, the circuitry 1492 may include one or more features of an anisotropic magnetoresistive (AMR) integrated circuit (IC). For example, consider a HONEYWELL VM series AMR sensor that may provide for detection of speed and/or direction of a ring magnet encoder target using a bridge design and configuration (see, e.g., VM721 D1 AMR 2-Pin PWM sensor IC, VM721 V1 AMR 2-Pin sensor IC, etc.). As an example, an AMR sensor may include a number of pins for use in speed sensing, position sensing, speed and position sensing, etc.

In the example of FIG. 14, a cutter 1440 can include a sleeve portion 1441 and a rotatable post portion 1443 supported by the sleeve portion 1441 where the rotatable post portion 1443 can include a face 1444 as a cutting face. As shown, a magnet assembly 1480 may be coupled to the rotatable post portion 1443 whereby the circuitry 1492 may be fixed in a reference frame for sensing speed and/or position of the rotatable post portion 1443 via the magnet assembly 1480 as the magnet assembly 1480 moves with the rotatable post portion 1443. As shown, poles of magnets of the magnet assembly 1480 may be alternating. As an example, a magnet assembly may include a circumferential ring of magnets (e.g., radially facing magnets) and/or an annular ring of magnets (e.g., axially facing magnets).

As shown in FIG. 14, one or more magnets may be part of an assembly 1490 that may include one or more diametrically opposed magnets positioned with respect to one or more sensors 1492, 1492-1, and 1492-2. There are two main types of magnetizations in permanent magnets, which are axial and diametric. For example, consider one or more of discs, cylinders, and ring magnets. An axial magnet tends to have north and south poles that are on flat surfaces of the magnet; whereas, a diametric magnet tends to have north and south poles that are on rounded edges of the magnet.

As explained, an assembly may include an arrangement of components where signals can be generated corresponding to one or more of angle of rotation, angular rate, axial position, axial rate, etc. As explained, circuitry may include a magnetic encoder IC, which may be an ASIC that may include or be operatively coupled to one or more Hall effect sensors (e.g., consider orthogonal Hall effect sensors). As explained, circuitry may include signal conditioning and processing capabilities, for example, to directly output rate, angle, sense of rotation, etc., in a digital format. As to resolution, circuitry may provide for an angular resolution of less than one degree and/or an axial resolution of less than 1 mm.

As explained, the drill bit 400 of FIG. 5 may include the sensor circuitry 590, which may be provided as one or more instances of the sensor circuitry 590. As an example, the sensor circuitry 590 may include one or more features of the circuitry 1492 of FIG. 14.

As an example, a blade may be manufactured using one or more techniques. For example, consider an additive manufacturing technique, a subtractive manufacturing technique, etc. As to an additive manufacturing technique, consider a 3D printing technique. In such an example, a blade may be printed using a suitable material to include a cutter pocket which may be suitable for receipt of a rotatable cutter (e.g., consider an ENDURO 360 cutter, etc.). As explained, a pocket may include a recess for seating at least a portion of a sensor, which may include associated circuitry. For example, consider a slot shaped recess that may receive a Hall effect sensor. As explained, a cutter may be formed or otherwise fit with one or more magnets. For example, consider a cutter with magnets arranged in a circular manner. In such an example, an assembly may provide for generation of signals and operate as a rotary encoder. As an example, when a front face of a cutter of a blade of a drill bit is in contact with rock and rotates due to frictional interaction with the rock, one or more magnets may also rotate and pass a Hall effect sensor mounted in the blade of the drill bit, for example, each time a predetermined angle may be subtended (e.g., consider an angle from less than one degree to 45 degrees or more than 45 degrees). As an example, a change in an angle of approximately 45 degrees (e.g., plus or minus 5 degrees) may provide a voltage change in a Hall effect sensor output. Such an approach may depend on a number of Hall effect sensors, a number of magnets, etc.

As an example, a steel such as, for example, a stainless steel may be utilized in 3D additive manufacturing. For example, consider SAE 316L grade stainless steel. SAE 316L grade stainless steel, sometimes referred to as A4 stainless steel or marine grade stainless steel, is an austenitic stainless steel with primary alloying constituents, after iron, being chromium (e.g., between approx. 16-18%), nickel (e.g., between approx. 10-12%) and molybdenum (e.g., between approx. 2-3%), up to approx. 2% manganese, where small (<1%) quantities of silicon, phosphorus and/or sulfur may also be present.

As an example, one or more 41xx steels of the family of SAE steel grades may be utilized, which can include alloying elements such as chromium and molybdenum such that these materials may be referred to as chromoly steels. While these grades of steel can include chromium, the amount tends to be insufficient to provide the level of corrosion resistance of stainless steel.

As an example, a bit body may be made of a 41xx grade steel and a blade and/or other unit may be made of a stainless steel. As an example, a component may be coated. For example, consider a steel component coated with manganese phosphate (e.g., consider performing a phosphate conversion coating process). As an example, a bit body may be made of steel with a phosphate conversion coating (e.g., manganese phosphate, etc.).

Figure 15:
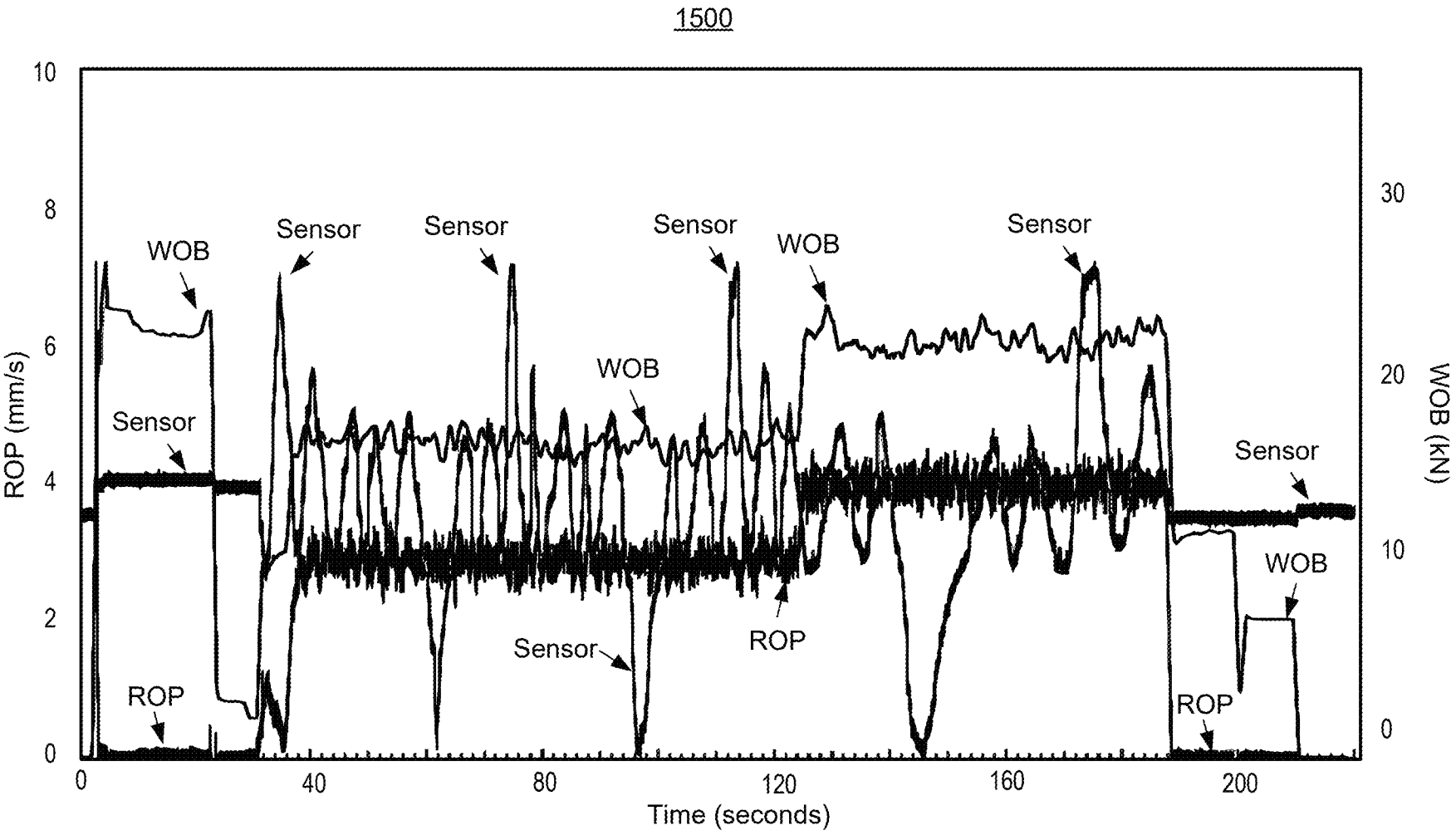
FIG. 15 illustrates an example of a graphical user interface.

FIG. 15 shows an example of a graphical user interface (GUI) 1500 that includes plots of composite time series data showing angular rate of cutter labeled sensor along with drilling machine WOB and ROP. As shown, time series data for a cutter may be associated with one or more other types of time series data. In the example of FIG. 15, the GUI 1500 shows cutter movement data along with other data that may cause cutter movement and/or a rate of cutter movement.

In the example of FIG. 15, peaks in the angular rate sensor signal can correspond to 45 degrees of rotation by the cutter. As indicated, a cutter of a drill bit may rotate relatively slowly compared to the drill bit; noting that periodicity between pulses may be assessed for regularity. In general, at higher WOB, the angular rate of the cutters slows slightly. In the example of FIG. 15, the cutter rotates anti-clockwise when viewed face on.

As explained, a single axis Hall effect sensor may be utilized or, for example, multiple Hall effect sensors may be utilized (e.g., consider orthogonal sensors). As explained, a magnetic encoder IC may be utilized, which may, for example, output sub-degree angular measurement and also output angular frequency and sense of rotation.

As shown in the data of the GUI 1500, an angular rate sensor can generate features which relate to rock-cutter interaction and a process of rock destruction. In various trials, acquired data may indicate the presence of relatively discrete steps that may relate to chipping behavior of rock. As an example, an angular rate of a cutter of a blade of a drill bit can depend on a rotation rate of the drill bit, rock type and a force balance acting on a front of the cutter.

Figure 16:
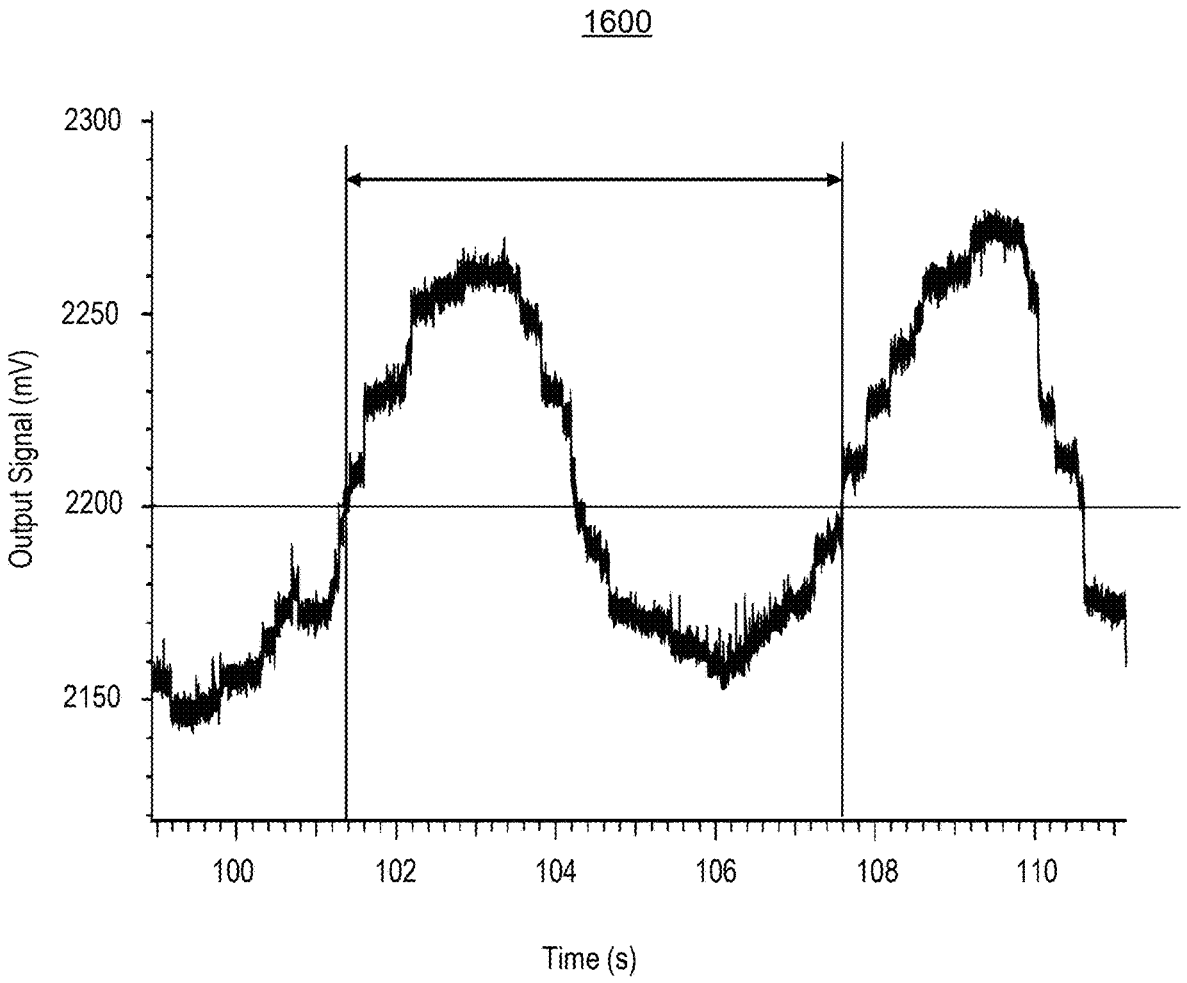
FIG. 16 illustrates an example of a graphical user interface.

FIG. 16 shows an example of a graphical user interface 1600 that includes data for an output signal in millivolts (mV) versus time in seconds (s). As shown, the output signal cycles where a cycle time may be identified, for example, as being on the order of approximately 6 seconds. In such an example, a Hall effect signal in drill experiments may exhibit discrete steps in output voltage where such steps relate to the underlying rock cutting (e.g., chipping) behavior and where the rate may depend on a drill bit rotary speed, rock type and/or one or more drilling parameters. In the example of FIG. 16, an arrow between the two vertical markers denotes 45 degrees of rotation of the cutter.

Figure 17:
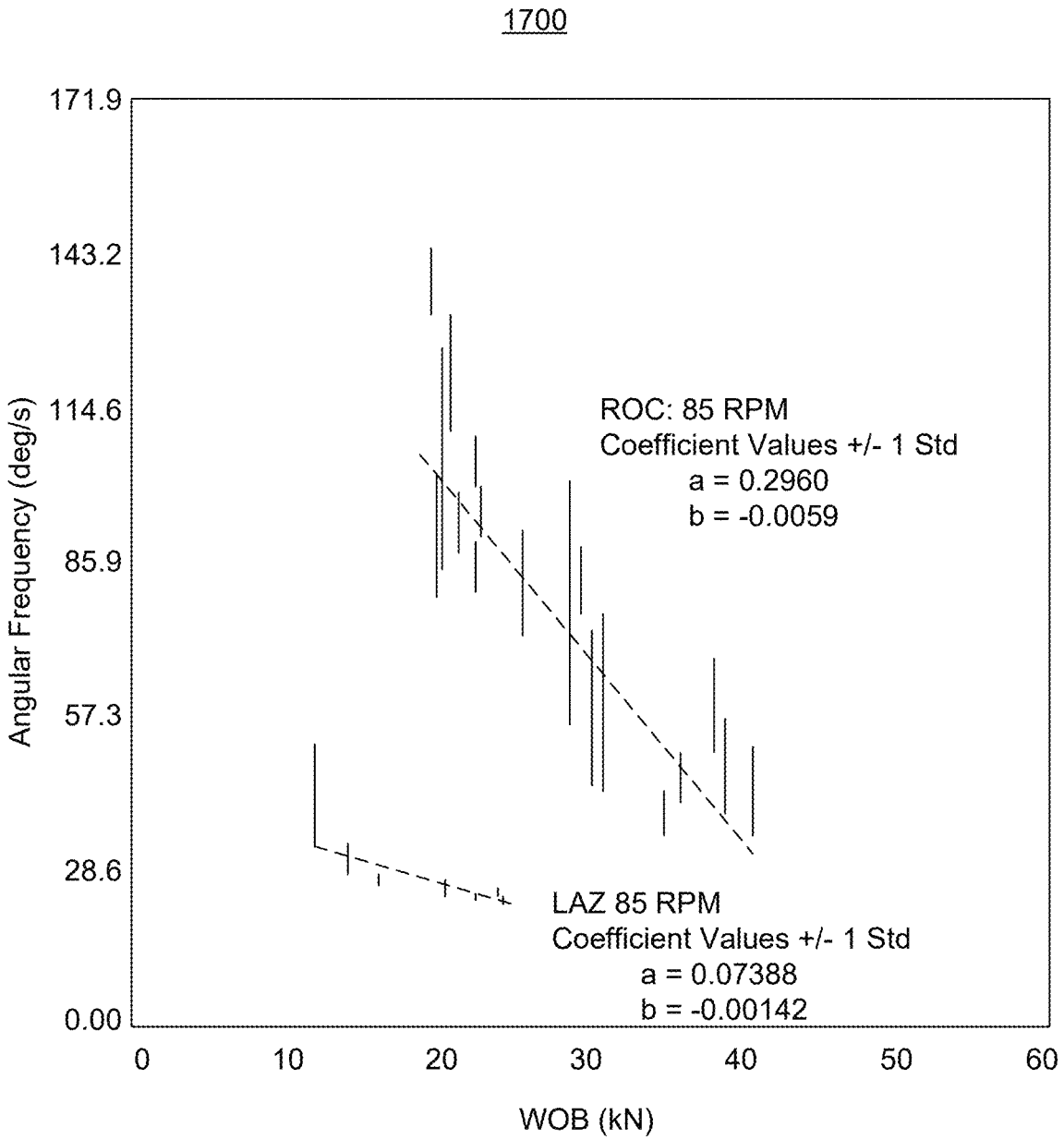
FIG. 17 illustrates an example of a graphical user interface.

FIG. 17 shows an example of a graphical user interface (GUI) 1700 that includes data for angular frequency in degrees per second (degrees/s) versus weight on bit (WOB) in kilonewtons (kN). In the GUI 1700, data are included for two different types of rock for a range of ROPs where one type of rock is a sandstone (LAZ) and where the other type of rock is a limestone (ROC).

As an example, signal processing may be applied to output of one or more Hall effect sensors when cutting rocks, which may provide for detection and characterization of the nature of discrete jumps, which may be different in terms of size of the jumps and also in temporal or spatial distribution (e.g., given that a drill bit is rotating).

Figure 18:
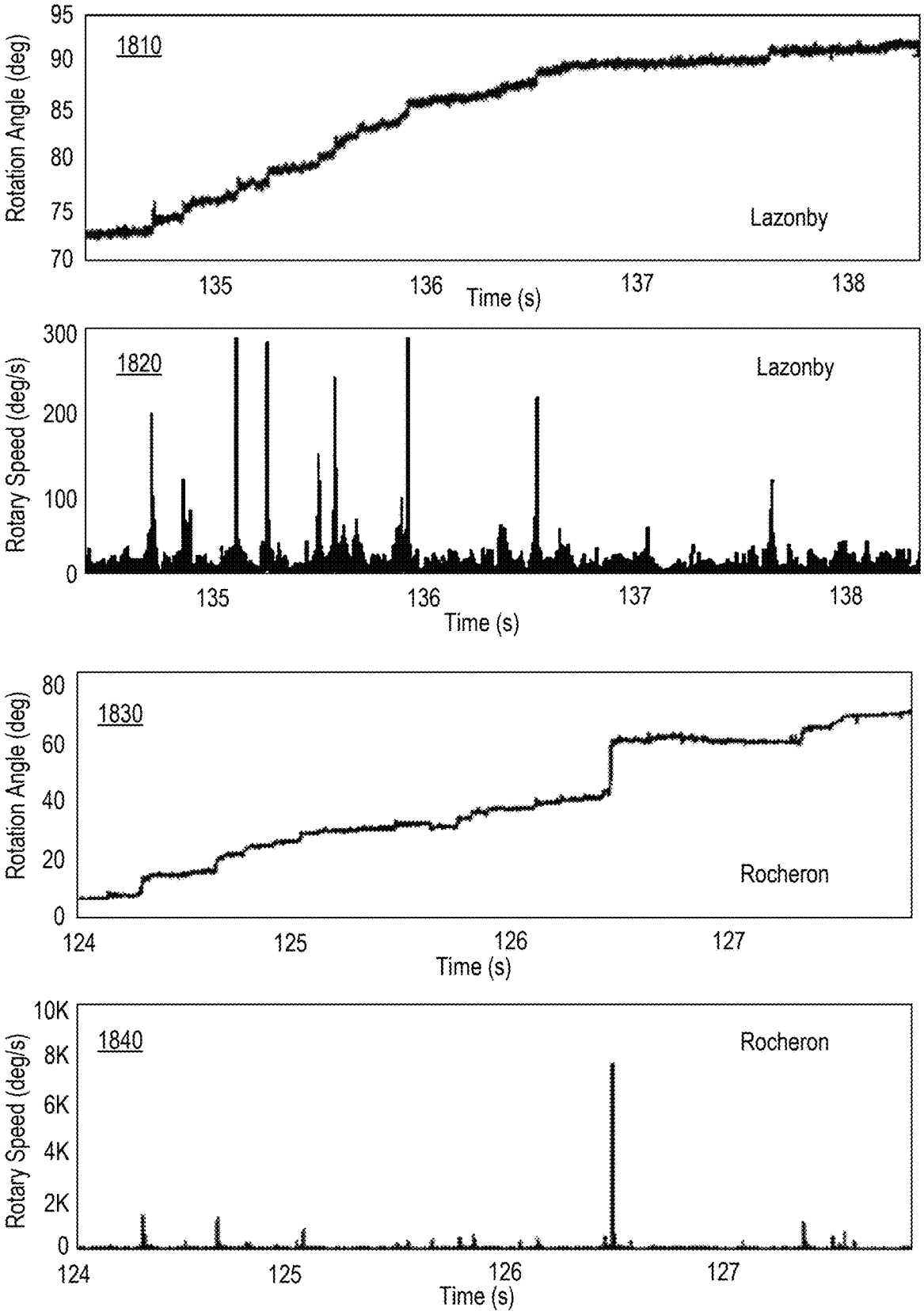
FIG. 18 illustrates examples of plots.

FIG. 18 shows example plots 1810, 1820, 1830, and 1840 that may be included in one or more GUIs where the plots 1810 and 1820 correspond to a Lazonby (e.g., LAZ) type of rock and where the plots 1830 and 1840 correspond to a Rocheron (e.g., ROC) type of rock. As an example, a method may include differentiating data for angle versus time where an angular rate can be determined that may indicate that jumps provide a characteristic signature in different rocks. As explained, such a signature may be related to individual chips being created in the rock and the aftermath of their creation, for example, where a cutter moves through a geometry that has been created. In various trials, an angular rate difference between observed in sandstone and limestone may differ at times by approximately an order of magnitude. For example, consider the plots 1820 and 1840 where rotary speed in the plot 1820 has a maximum of approximately 290 degrees/s and where rotary speed in the plot 1840 generally has a maximum of approximately 2000 degrees/s, noting that a particular jump exhibited a rotary speed of approximately 8000 degrees/s.

As explained, signal processing of output of a single hall effect sensor can demonstrates the ability to resolve a magnetic field of a number of magnets (e.g., 8 magnets) into a rotation angle. For example, consider the plots 1810 and 1820 as to rotation angle versus time for Lazonby sandstone and the plots 1830 and 1840 as to rotation angle versus time for Rocheron limestone. Differentiation of these signals allows the angular frequency to be resolved (see, e.g., the plots 1820 and 1840). Per the data, sandstone shows that discrete steps in rotation tend to have an angular rate that is smaller than that seen in limestone, for example, by an order of magnitude or less.

As explained, rotating cutters can be instrumented to provide indirect information which can be related to one or more of properties of rock, frictional contact at a periphery of a cutter, drilling parameters, chip length and chipping rate.

Figure 19:
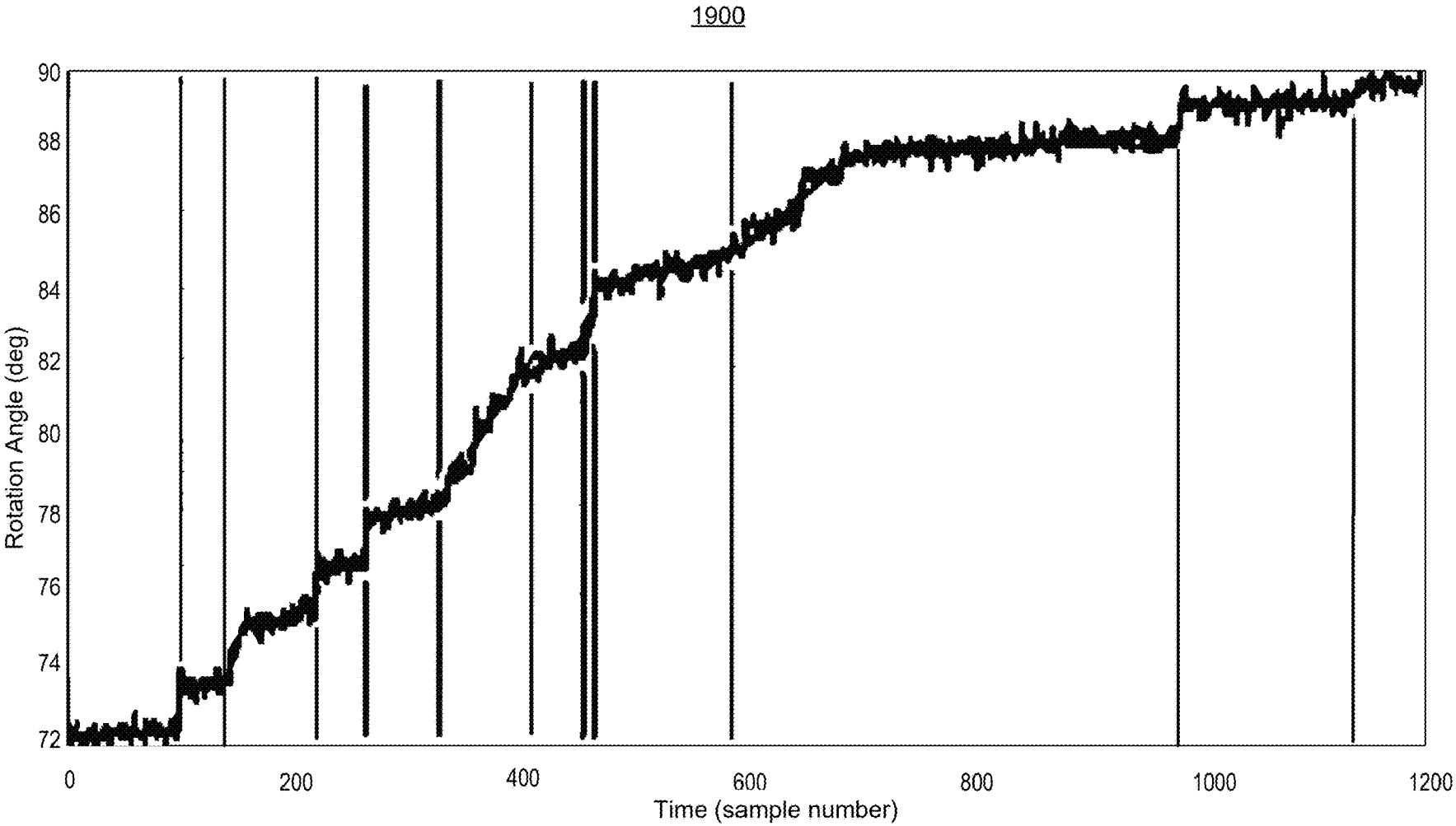
FIG. 19 illustrates an example of a graphical user interface.

FIG. 19 shows an example of a graphical user interface (GUI) 1900 of rotation angle in degrees (deg) versus time (per sample number). In the example GUI 1900, a change-point technique or other suitable technique may be used to detect discrete jumps in angle (see, e.g., vertical lines). Such an approach may be used to generate a histogram of time between successive angular rate change with a length of a path swept out by a cutter. Such an approach may provide for generating an indication of a chip size and/or a chip size distribution.

As explained, a drill bit may include one or more instrumented cutters, which may be robust for operation in a downhole environment. In various instances, sensing of rotation may not be substantially affected by pressure and may be protected to a large degree from the environment (e.g., consider locations of sensors and/or circuitry that may help to provide for robust operation).

As an example, data may be acquired and stored locally to memory and retrieved upon bringing a drill bit to surface and/or positioning a drill bit proximate to a memory reader, etc. As an example, data may be transmitted using one or more telemetry techniques and/or technologies. For example, consider transmission to one or more other drill-string components and/or to surface equipment.

As an example, data may be utilized at surface and/or downhole to control one or more field operations. For example, consider control of WOB, RPM, etc., which may provide for control of ROP, etc. As an example, where a drillstring is instrumented with one or more active components that may provide for steering such as, for example, geosteering, data from one or more instrumented cutters may provide for guiding geosteering, which may be in a manner whereby drilling in an anisotropic formation generates data related to direction of drilling and/or whereby drilling in a formation with natural fractures generates data related to direction of drilling. In such examples, steering may provide for directing a drill bit in a direction relative to anisotropy and/or to natural fractures.

As explained, a drill bit with one or more instrumented cutters may provide for detection of formation changes and/or drilling characteristics. As an example, a drill bit with one or more instrumented cutters may provide for generation of output as to one or more of chip size, chip size distribution, rock-cutter properties (e.g., friction, hardness, cutter response, etc.), formation change detection, WOB sensing, drill bit to cutter speed ratio, prognostic monitoring of drill bit use and abuse, ROP determination (e.g., through differential cutter measurements), cutter condition (e.g., edge damage, etc.), changes in a leading cutter changing a silhouette of rock to be cut, etc.

As explained, heat may be generated during cutter operation. As an example, a drill bit may include one or more cutters instrumented for temperature acquisition, which may be localized to a portion of a cutter and/or may provide for comparison of temperatures of a number of cutters. As an example, cutter movement data may be utilized in combination with temperature and/or one or more other types of data.

As an example, an interpretation of cutter speed may be resolved as a drill bit rotates such that combining the interpretation with a drill bit orientation measurement, an azimuthal rock property variation may be characterized. For example, consider utilization of such an approach to enable identification of one or more bed boundaries. As to heterogeneous unconventional reservoirs, such an approach may provide for identification of one or more beds, which may include, for example, one or more ash beds, which may impact fracturing performance. As an example, such information may be used in drilling a trajectory and/or in generating a completion design. As an example, an interpretation may use changes in relative velocity as well as in one or more chipping characteristics derived from cutter speed.

As an example, data from a drill bit that includes one or more instrumented cutters may be utilized for cuttings analysis. For example, consider a method that may involve acquiring one or more cuttings samples from drilling fluid where characteristics of cuttings may be related to data from one or more instrumented cutters of a drill bit.

As an example, a workflow involving cutting analysis may involve various actions such as, for example, sample collection, sample preparation, photo acquisition, and photo analysis. As explained, during normal operation, rocks crushed by a rotating drill bit may be transported to surface, for example, to a shale shaker. The cuttings may be separated by the shale shaker such that liquid and other components may be reused (e.g., circulated downhole). Cuttings, as rock particles, may be analyzed by mud loggers operating in a mud logging unit. Such analyses may be dependent on having one or more humans-in-the-loop (HITL) or, for example, may involve using a system that provides for automation that may reduce demands on including one or more humans on site in a mud logging unit. For example, a system may provide for automating a workflow for cuttings analysis.

As an example, a mud logger may perform mudlogging, which involves collection of fragments of drilled rock, known as cuttings, during drilling operations, which may then be prepared (e.g., rinsed and dried), and examined under a binocular microscope. Such examination may provide for a description of characteristics such as lithology, texture, color, grain size, and other pertinent physical characteristics, which may include identifying a presence of hydrocarbons.

Figure 20:
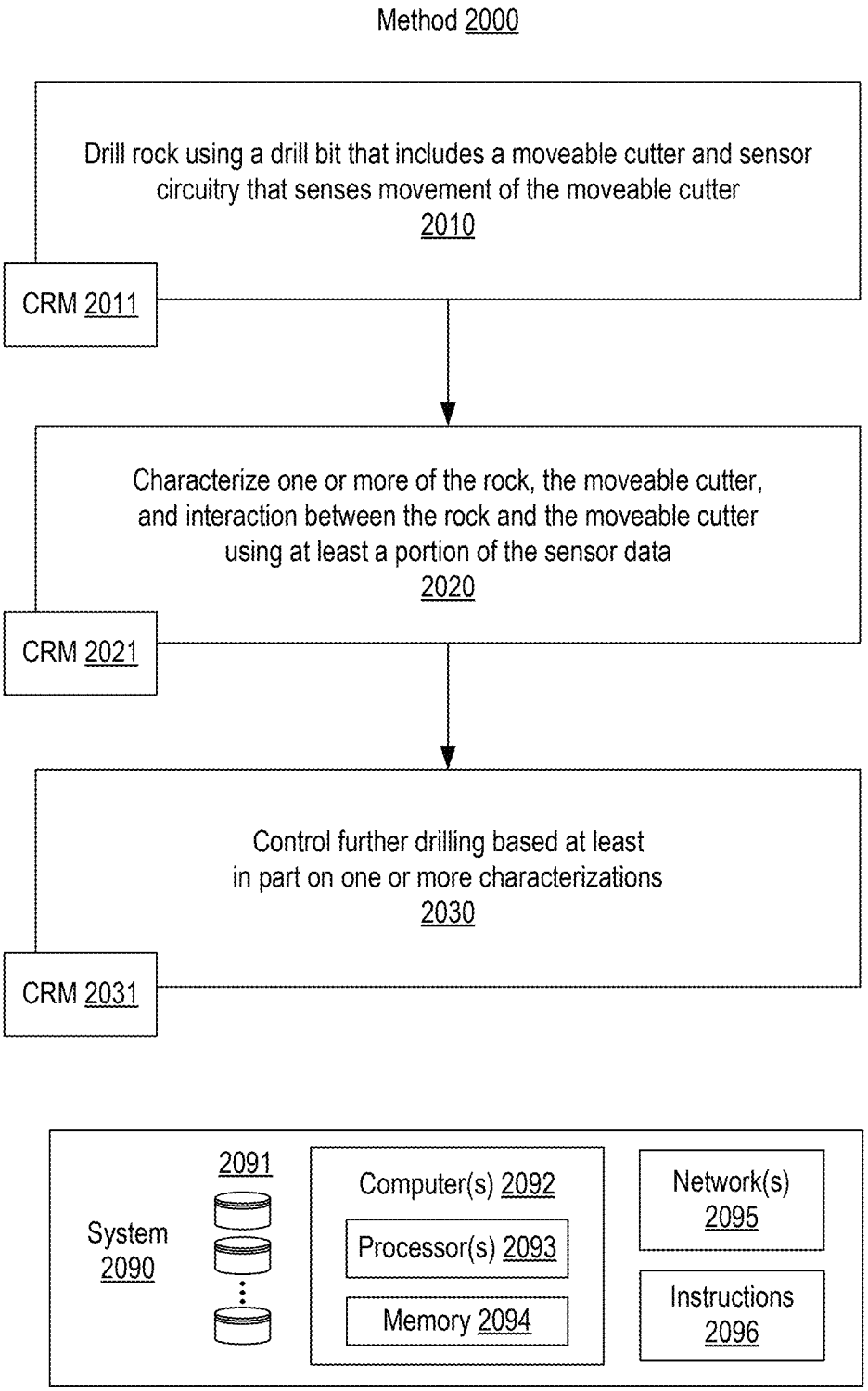
FIG. 20 illustrates an example of a method and an example of a system.

FIG. 20 shows an example of a method 2000 that includes a drill block 2010 for drilling rock using a drill bit that includes a bit body, a blade mountable to the bit body, where the blade includes pockets, a moveable cutter disposed in one of the pockets, and sensor circuitry that senses movement of the moveable cutter disposed in the one of the pockets to generate sensor data; and a characterization block 2020 for characterizing one or more of the rock, the moveable cutter, and interaction between the rock and the moveable cutter using at least a portion of the sensor data. As an example, the method 2000 may include a control block 2030 for controlling further drilling based at least in part on one or more characterizations (e.g., as based on the sensor data).

FIG. 20 also shows various computer-readable media (CRM) blocks 2011, 2021, and 2031. Such blocks may include instructions that are executable by one or more processors, which may be one or more processors of a computational framework, a system, a computer, etc. A computer-readable medium may be a computer-readable storage medium that is not a signal, not a carrier wave and that is non-transitory. For example, a computer-readable medium may be a physical memory component that may store information in a digital format.

In the example of FIG. 20, a system 2090 includes one or more information storage devices 2091, one or more computers 2092, one or more networks 2095 and instructions 2096. As to the one or more computers 2092, each computer may include one or more processors (e.g., or processing cores) 2093 and a memory 2094 for storing the instructions 2096, for example, executable by at least one of the one or more processors. As an example, a computer may include one or more network interfaces (e.g., wired or wireless), one or more graphics cards, a display interface (e.g., wired or wireless), etc. The system 2090 may be specially configured to perform one or more portions of the method 2000 of FIG. 20.

As an example, a system may employ one or more machine learning models. For example, consider one or more trained machine learning models that may provide for receiving sensor data and outputting one or more characterizations. In such an example, one or more trained machine learning models may provide for outputting one or more characteristics of rock, which may be physical characteristics, characteristics of a drill bit, which may be cutter characteristics, and characteristics of rock and cutter interaction.

As to types of machine learning models, consider one or more of a support vector machine (SVM) model, a k-nearest neighbors (KNN) model, an ensemble classifier model, a neural network (NN) model, etc. As an example, a machine learning model may be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model, which may be a machine learning model (ML model), may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange to various other frameworks.

As an example, the TENSORFLOW framework (Google LLC, Mountain View, CA) may be implemented, which is an open-source software library for dataflow programming that includes a symbolic math library, which may be implemented for machine learning applications that may include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method may include various actions that may operate on a dataset to train a ML model. As an example, a dataset may be split into training data and test data where test data may provide for evaluation. A method may include cross-validation of parameters and best parameters, which may be provided for model training.

The TENSORFLOW framework may run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system-based platforms.

TENSORFLOW computations may be expressed as stateful dataflow graphs; noting that the name TENSORFLOW derives from the operations that such neural networks perform on multidimensional data arrays. Such arrays may be referred to as "tensors".

As an example, a device may utilize TENSORFLOW LITE (TFL) or another type of lightweight framework. TFL is a set of tools that enables on-device machine learning where models may run on mobile, embedded, and IoT devices. TFL is optimized for on-device machine learning, by addressing latency (no round-trip to a server), privacy (no personal data leaves the device), connectivity (Internet connectivity is demanded), size (reduced model and binary size) and power consumption (e.g., efficient inference and a lack of network connections). TFL includes multiple platform support, covering ANDROID and iOS devices, embedded LINUX, and microcontrollers and diverse language support, which includes JAVA, SWIFT, Objective-C, C++, and PYTHON. TFL provides for high performance, with hardware acceleration and model optimization.

As an example, a drill bit can include a bit body; a blade mountable to the bit body, where the blade includes pockets; a moveable cutter disposed in one of the pockets; and sensor circuitry that senses movement of the moveable cutter disposed in the one of the pockets to generate sensor data. In such an example, the blade can include a sensor circuitry recess.

As an example, a moveable cutter can be or include a rotatable cutter. In such an example, a rotatable cutter can include a sleeve portion and a post portion rotatable within the sleeve portion.

As an example, a moveable cutter can include one or more magnets, where, for example, sensor circuitry includes one or more Hall effect sensors. In such an example, the sensor circuitry may include at least two orthogonal Hall effect sensors.

As an example, sensor circuitry may include one or more optical sensors. For example, consider an optical sensor that may provide for sensing a position of a marker, a pattern, etc. In such an example, the optical sensor may include an emitter and a receiver where the receiver may receive reflected, transmitted, absorbed, etc., radiation (e.g., light, IR, UV, etc.). In such an example, an optical sensor may provide for sensing rotation and/or rotational position of a rotatable cutter seated in a pocket of a drill bit (e.g., a drill bit blade pocket, etc.).

As an example, sensor data may include angle position data for an angle of a moveable cutter with respect to one of a number of pockets. As an example, sensor data may be for channels for each channel corresponds to sensor data for a movable cutter in a respective pocket.

As an example, sensor data may include angle rate data for angular rotation of a moveable cutter with respect to one of a number of pockets. As an example, sensor data may be for channels for each channel corresponds to sensor data for a movable cutter in a respective pocket.

As an example, sensor data may include indicia of formation type and/or formation properties encountered by the drill bit. For example, consider sensor data as including indicia of a particular type of rock. As an example, sensor data may provide for determining a type of rock being cut by a drill bit and/or for determining one or more rock interfaces between rock of different types, properties, etc. As to properties, consider one or more of mechanical properties, chemical properties, porosity, permeability, fluid content, etc.

As an example, sensor data may include indicia of rock chip size of rock encountered by a drill bit. For example, consider indicia as to cycles of rotation of a moveable cutter in a corresponding pocket with respect to time. In such an example, sensor circuitry may provide for identifying the cycles and relating cycle length to rock chip size.

As an example, a drill bit may include two or more moveable cutters and one or more instances of sensor circuitry.

As an example, a method can include drilling rock using a drill bit that includes a bit body, a blade mountable to the bit body, where the blade includes pockets, a moveable cutter disposed in one of the pockets, and sensor circuitry that senses movement of the moveable cutter disposed in the one of the pockets to generate sensor data; and characterizing one or more of the rock, the moveable cutter, and interaction between the rock and the moveable cutter using at least a portion of the sensor data. In such an example, the method may further include controlling further drilling of the rock based at least in part on the characterizing.

As an example, characterizing rock may include determining one or more physical properties of the rock and/or characterizing a moveable cutter may include determining wear of the moveable cutter. As an example, characterizing interaction between rock and a moveable cutter may include determining a chip size of rock chips formed by the interaction between the rock and the moveable cutter.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave. As an example, a computer-program product may include instructions suitable for execution by one or more processors (or processor cores) where the instructions may be executed to implement at least a portion of a method or methods.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 21:
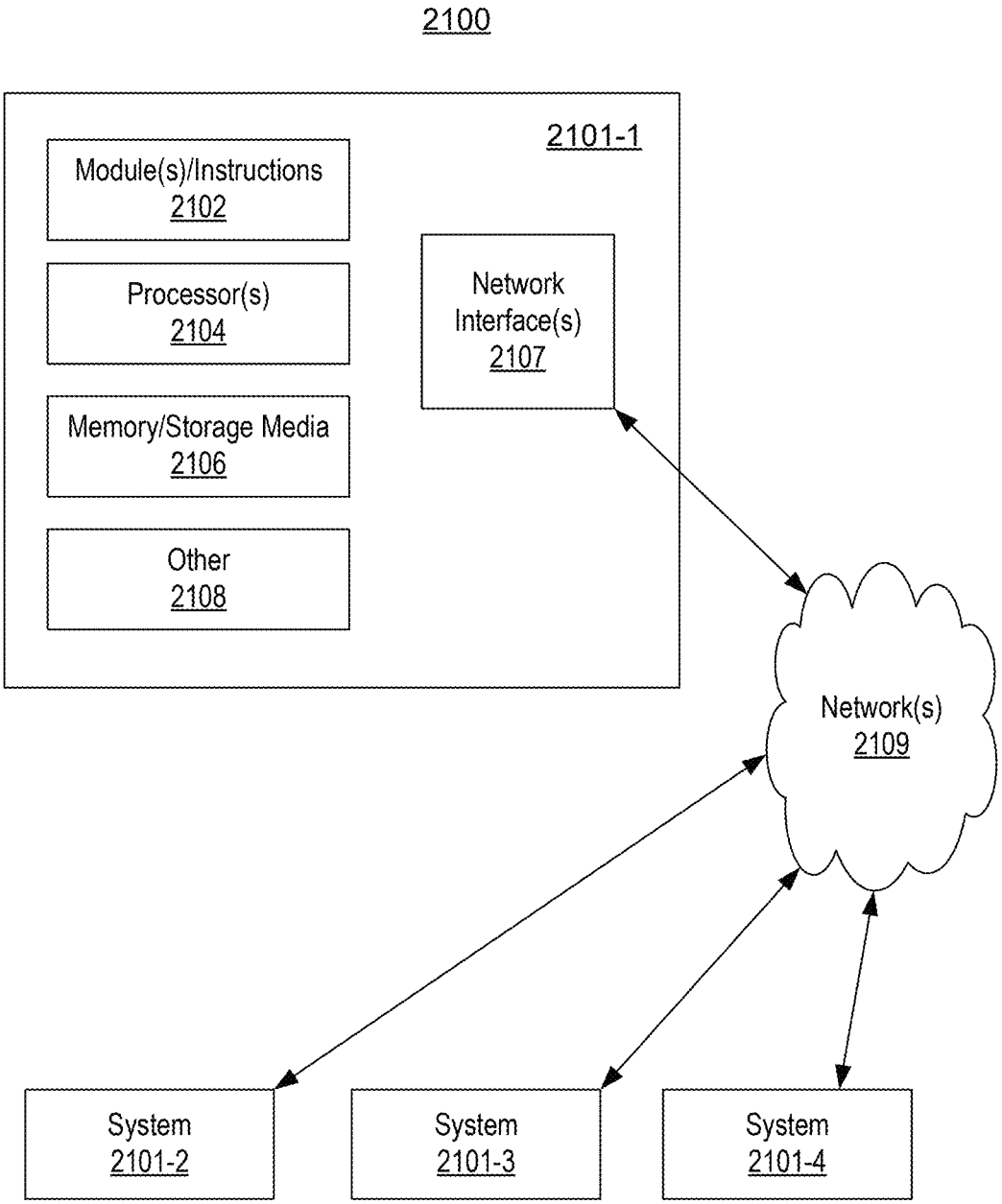
FIG. 21 illustrates an example of computing system.

In some embodiments, a method or methods may be executed by a computing system. FIG. 21 shows an example of a system 2100 that may include one or more computing systems 2101-1, 2101-2, 2101-3 and 2101-4, which may be operatively coupled via one or more networks 2109, which may include wired and/or wireless networks.

As an example, a system may include an individual computer system or an arrangement of distributed computer systems. In the example of FIG. 21, the computer system 2101-1 may include one or more modules 2102, which may be or include processor-executable instructions, for example, executable to perform various tasks (e.g., receiving information, requesting information, processing information, simulation, outputting information, etc.).

As an example, a module may be executed independently, or in coordination with, one or more processors 2104, which is (or are) operatively coupled to one or more storage media 2106 (e.g., via wire, wirelessly, etc.). As an example, one or more of the one or more processors 2104 may be operatively coupled to at least one of the one or more network interface 2107. In such an example, the computer system 2101-1 may transmit and/or receive information, for example, via the one or more networks 2109 (e.g., consider one or more of the Internet, a private network, a cellular network, a satellite network, etc.). As shown, one or more other components 2108 may be included in the computer system 2101-1.

As an example, the computer system 2101-1 may receive from and/or transmit information to one or more other devices, which may be or include, for example, one or more of the computer systems 2101-2, etc. A device may be located in a physical location that differs from that of the computer system 2101-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 2106 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general-purpose processor or application specific chips (e.g., or chipsets), such as ASICs, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that may be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A drill bit comprising:

a bit body;

a blade separate from the bit body, wherein the blade comprises a plurality of pockets, a sensor circuitry recess, and at least one coupler configured to securely mount the blade to the bit body such that the blade is rigidly attached to the bit body;

a rotatable cutter disposed in a particular pocket of the plurality of pockets of the blade, wherein the rotatable cutter is configured to rotate within the particular pocket; and sensor circuitry disposed in the sensor circuitry recess of the blade, wherein the sensor circuitry is configured to sense rotational movement of the rotatable cutter within the particular pocket to generate sensor data.

2. The drill bit of claim 1, wherein the rotatable cutter comprises a sleeve portion and a post portion rotatable within the sleeve portion.

3. The drill bit of claim 1, wherein the rotatable cutter comprises at least one magnet, and wherein the sensor circuitry comprises at least one Hall effect sensor.

4. The drill bit of claim 3, wherein the sensor circuitry comprises at least two orthogonal Hall effect sensors.

5. The drill bit of claim 1, wherein the sensor circuitry comprises at least one optical sensor.

6. The drill bit of claim 1, wherein the sensor data comprise angle position data for an angle of the rotatable cutter that results from rotation of the rotatable cutter within the particular pocket.

7. The drill bit of claim 1, wherein the sensor data comprise angle rate data for angular rotation of the rotatable cutter that results from rotation of the rotatable cutter within the particular pocket.

8. The drill bit of claim 1, wherein the sensor data is processed to determine at least one formation property of a formation encountered by the drill bit.

9. The drill bit of claim 8, wherein the at least one formation property includes formation type.

10. The drill bit of claim 8, wherein the at least one formation property includes rock chip size of rock encountered by the drill bit.

11. The drill bit of claim 8, wherein the processing of the sensor data determines cycles of rotation of the rotatable cutter within the particular pocket with respect to time.

12. The drill bit of claim 11, wherein the processing of the sensor data identifies the cycles and relates cycle length to rock chip size.

13. The drill bit of claim 1, further comprising at least two rotatable cutters and at least one of the sensor circuitry.

14. A method comprising:

drilling rock using a drill bit according to claim 1 to generate sensor data; and characterizing at least one of the rock, the rotatable cutter, and interaction between the rock and the rotatable cutter by processing at least a portion of the sensor data.

15. The method of claim 14, comprising controlling further drilling of the rock based at least in part on the characterizing.

16. The method of claim 14, wherein the characterizing comprises determining at least one physical property of the rock.

17. The method of claim 14, wherein the characterizing comprises determining wear of the rotatable cutter.

18. The method of claim 14, wherein the characterizing comprises determining a chip size of rock chips formed by the interaction between the rock and the rotatable cutter.

19. The drill bit of claim 1, wherein the at least one coupler of the blade comprises at least one of: a bore configured to receive a bolt or rod, and a keyway configured to receive a key.

* * * * *